US007669369B2

(12) United States Patent
Henry et al.

(10) Patent No.: US 7,669,369 B2
(45) Date of Patent: Mar. 2, 2010

(54) DOOR THRESHOLD WATER RETURN SYSTEMS

(75) Inventors: Michael Henry, 17171 Bothell Way NE, PMB 142, Lake Forest Park, WA (US) 98155; Ann Henry, Lake Forest Park, WA (US)

(73) Assignee: Michael Henry, Seattle, WA (US)

( * ) Notice: Subject to any disclaimer, the term of this patent is extended or adjusted under 35 U.S.C. 154(b) by 209 days.

(21) Appl. No.: 11/331,891

(22) Filed: Jan. 12, 2006

(65) Prior Publication Data

US 2006/0150521 A1 Jul. 13, 2006

Related U.S. Application Data

(60) Provisional application No. 60/643,678, filed on Jan. 12, 2005.

(51) Int. Cl.
*E06B 1/70* (2006.01)

(52) U.S. Cl. ..... 49/471; 49/408; 52/204.1

(58) Field of Classification Search ..... 49/471, 49/467, 408; 52/204.1
See application file for complete search history.

(56) References Cited

U.S. PATENT DOCUMENTS

| | | | |
|---|---|---|---|
| 322,086 | A | 7/1885 | Bartholomew |
| 2,202,482 | A | 5/1940 | Dahl |
| 3,410,027 | A | 11/1968 | Bates |
| 3,851,420 | A | 12/1974 | Tibbetts |
| 4,055,917 | A | 11/1977 | Coller |
| 4,229,905 | A | 10/1980 | Rush |
| 4,310,991 | A | 1/1982 | Seely |
| 4,513,536 | A | 4/1985 | Giguere |
| 4,686,793 | A | 8/1987 | Mills |
| 4,716,683 | A | 1/1988 | Minter |
| 4,831,779 | A | 5/1989 | Kehrli et al. |
| 4,999,950 | A | 3/1991 | Beske et al. |
| 5,018,307 | A | 5/1991 | Burrous et al. |
| 5,067,279 | A | 11/1991 | Hagemeyer |
| 5,136,814 | A | 8/1992 | Headrick |
| 5,179,804 | A | 1/1993 | Young |
| 5,469,665 | A | 11/1995 | Biebuyck |
| 5,687,508 | A | 11/1997 | Fitzhenry, Jr. et al. |
| 5,943,825 | A | 8/1999 | Procton et al. |
| 5,956,909 | A | 9/1999 | Chou |
| 6,052,949 | A | 4/2000 | Procton et al. |
| 6,138,413 | A | 10/2000 | Fehr |

(Continued)

OTHER PUBLICATIONS

Pemko Manufacturing Co., "Residential Thresholds," Catalog, 2004, pp. 29-48, United States.

*Primary Examiner*—Jerry Redman
(74) *Attorney, Agent, or Firm*—Ann W. Speckman; Victor N. King; Speckman Law Group PLLC

(57) ABSTRACT

A door threshold water return system, comprising: a lower sill; an upper sill; a rear wall; and a front wall forming a chamber, wherein at least one baffle is provided projecting into the chamber from the rear wall, a first gap is provided in proximity to the rear wall and between the upper sill and the rear wall, and a second gap is provided in proximity to the lower sill and between the lower sill and the front wall, whereby water introduced into the system through the first gap exits the system through the second gap.

12 Claims, 22 Drawing Sheets

U.S. PATENT DOCUMENTS 6,219,979 B1 4/2001 Lohr
6,289,635 B1 9/2001 Procton et al.
6,357,186 B1 3/2002 Gould
6,371,188 B1 4/2002 Baczuk et al.
6,665,989 B2 12/2003 Bennett
6,718,700 B2 4/2004 Rochman
6,789,359 B2 9/2004 Bauman et al.
7,263,808 B2 * 9/2007 Massey et al. ..... 52/204.1

* cited by examiner

FIGURE 13A
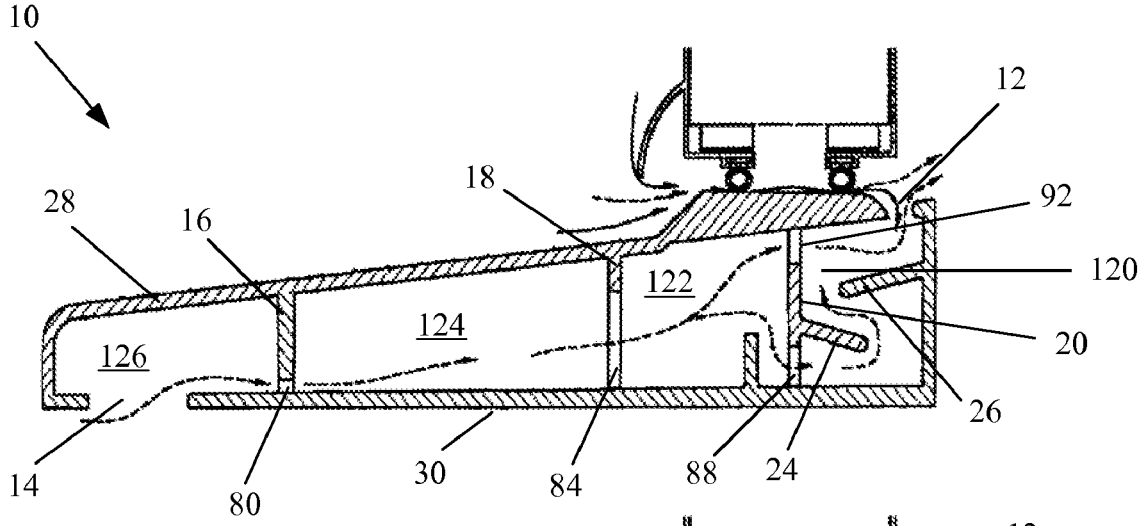
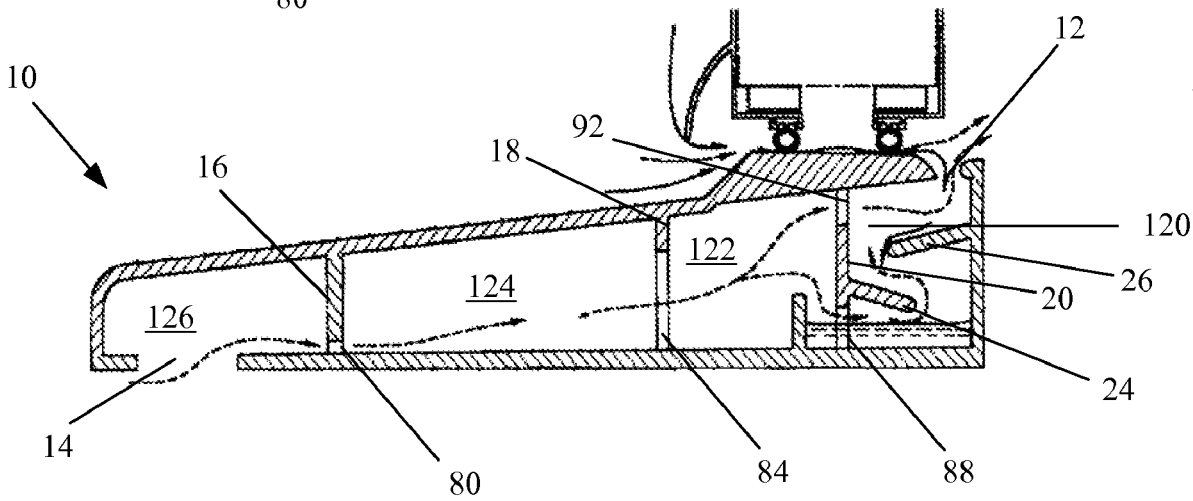
FIGURE 13B

DOOR THRESHOLD WATER RETURN SYSTEMS

CROSS REFERENCE TO RELATED APPLICATION

This application claims priority under 35 U.S.C. §119(e) to U.S. Provisional Application No. 60/643,678, filed Jan. 12, 2005.

FIELD OF THE INVENTION

The present invention relates generally to water return systems, and more particularly to door threshold water return systems.

BACKGROUND OF THE INVENTION

Residential door systems typically have a threshold at the base of a door assembly, having a door, which generally has a door shoe having a door seal around the perimeter of the door. Storm or wind driven rain, ice, hail, or snow can create an air pressure differential across the threshold of the door, resulting in higher air pressure at the exterior of the door than that at the interior of the door. This air differential forces water to be entrained in the high pressure air as the air flows across the door seal, which can migrate around some imperfect door seals and enter into the interior and living quarters of homes and buildings. This occurrence can often create safety hazards, damage, and deleterious effects to flooring and furnishings within the homes and buildings. A door threshold water return system generally can prevent such occurrences.

Different door threshold water return systems, seals, and the like are known and disclosed. U.S. Pat. No. 3,410,027 (Bates) discloses a threshold structure particularly for sliding panel closures having a fluid pressure head portion, which accumulates sufficient water to overbalance the pressure of the elements on the external side of the closure and produce an actual flow of water from the internal to the external side of the closure automatically and continuously, thereby eliminating the infiltration of water through the closure.

U.S. Pat. No. 4,831,779 (Kehrli et al.) discloses a self-draining panel threshold combination for a panel, such as a door or the like. The door threshold combination comprises weather seals around the entire periphery of the door lying in a weather seal plane. An open-ended water trough in the threshold extends from one jamb to the other, and lies substantially in the weather seal plane for catching water that leaks into and past the weather seals. The threshold has a weather seal adjacent to the water trough that is adapted when flexed by the closed door to allow entry of water into the open end of the water trough, and when unflexed upon movement of the door to its open position to cover the open end to prevent foreign material from entering the trough. A drainage system is provided for draining water entering the water trough out of the threshold.

U.S. Pat. No. 5,956,909 (Chou) discloses a water drainable threshold construction to be laid under a door, which includes a first extrusion, which has a longitudinal outside portion adapted to be placed outwardly of a bottom edge of a door, and a longitudinal inside portion lower than the outside portion. The inside portion has a space adapted for receiving water that flows from the outside portion. A tube extends from the inside portion to an outside portion for draining water from the space to the outside of the outside portion. A second extrusion is longitudinally mounted on the inside portion to cover the space, and has holes for passage of water into the space.

U.S. Pat. No. 6,789,359 (Bauman et al.) discloses a weeped end plug for a sill assembly, in which a sill assembly for doors and windows provides a weep system for channeling water away from the sill assembly. The sill assembly includes an elongated frame member formed with a longitudinally extending upwardly open channel that defines a rear wall, a front wall, and a floor that extends laterally and slopes downwardly from the rear wall to the front wall, and a sill that extends laterally from the front wall to a forward edge of the frame member. An end plug is securely mounted to one end of the elongated frame member and has a laterally extending drainage ramp disposed at a location flush with and immediately adjacent to the floor of the channel. The ramp leads to a drainage chamber, which in turn has an opening closed by a hinged weep door. Water collected in the channel of the frame member or that may get past the primary weather-strip of a door or window is collected in the channel and is fed to the ramp, which in turn directs the water into the drainage chamber and out the weep door, so that the water is directed away from the sill assembly.

U.S. Pat. No. 6,371,188 (Baczuk et al.) discloses a door assembly and a method for making a door sill assembly. One aspect of the invention relates to a door sill assembly having an open fluid receiving trough in its sub-sill. Another aspect relates to a door sill assembly having a tread structure that includes a lip for supporting a rectilinearly movable door panel, with a groove adjacent the lip for guiding fluid on the tread structure to opposing ends thereof.

U.S. Pat. No. 5,067,279 (Hagemeyer) discloses a door threshold water return system, which includes a wedge-shaped silicone check valve in communication with a water reservoir on the interior side. The check valve is normally closed, but will yieldably open in response to water pressure, which overcomes the resilience of the silicone material and air pressure on the top wall of the wedge-shaped passageway. The check valve functions as a seal against incoming air, but will open to allow water to escape, as needed. The silicone material seals around foreign material in the valve, making it substantially air tight. The bottom edge of the door includes moisture resistant material having an upwardly extending portion received in a groove. The exterior side of the door is also covered with moisture resistant material, which has inwardly extending portions received in a vertical groove between abutting panels. A moisture resistant plate extends along the bottom edge of the door, and has downwardly extending portions engaging the weather seal on the threshold on the exterior side and a wood portion of the threshold on the interior side. The plate directs water from the vertical groove outwardly of the door.

U.S. Pat. No. 6,357,186 (Gould) discloses a self-venting window frame, in which a hollow window frame structure is provided with a one way valve to permit flow from the exterior of a building to the interior of the building through the hollow frame, when the air pressure is higher outside than in the interior of the building, and impair flow from the interior of the building to the exterior of the building, when the air pressure in the interior of the building is higher than the exterior pressure.

U.S. Pat. No. 5,687,508 (Fitzhenry, Jr. et al.) discloses a water resistant door assembly, which includes a door frame, a door hingedly mounted with the frame, and a threshold. The threshold has a height selected to be equal to or greater than a water head at a pre-selected design wind load pressure, as a primary means to resist water intrusion. A series of gaskets, internal gutter troughs, and weep holes to the exterior of the door assembly provide a secondary means to resist water intrusion.

U.S. Pat. No. 5,018,307 (Burrous et al.) discloses a self-draining hollow threshold for an out-swinging door of an enclosure, such as a room, which comprises an interior threshold portion extending into the enclosure, and having an upper wall. The interior threshold portion has a drainage system comprising a slot in the upper wall, for draining water that penetrates the plane of the door. The water flows over the upper wall and through the hollow threshold to the exterior of the door and enclosure.

U.S. Pat. No. 6,665,989 (Bennett) discloses an entryway system with leak managing corner pads, in which an improved corner pad for sealing the bottom corner of a closed door has a sloped upper surface that forms a reservoir between the closed door and the jamb. Rain water that is blown up the weather strip by wind is collected in the reservoir until the wind subsides, whereupon the water drains out.

U.S. Pat. No. 5,179,804 (Young) discloses a self draining door sill assembly for use in the bottom of an exterior door frame of a house or other building. The assembly includes an elongated base and a threshold member adjustably attached to the base, for cooperating with and engaging a weather strip attached to the underside of a door, when the door is closed in the frame, to form a primary water seal. The threshold and base define an elongated water chamber therebetween, and the threshold defines an upwardly opening storm drain channel formed in and along an upper, interior side surface portion thereof, which terminates in a pair of slots located in opposite ends of the threshold, which slots also communicate with the underlying water chamber. A pair of spaced apart weep channels are formed in the base and extend from a floor of the water chamber exteriorly along and through an exterior side of the base, such that rain water which blows or seeps past the primary seal gathers in the drain channel, flows through the slots onto the floor of the water chamber, migrates along the floor to the weep channels, and then flows through the weep channels out of the assembly. A weather cover panel covers an exterior side portion of the base, and a compressible resilient gasket is attached to the weather cover and fills a gap between the weather cover and the threshold member.

U.S. Pat. No. 4,686,793 (Mills) discloses a threshold, in which an elongated body is provided for use as a threshold, and is transversely stepped, whereby the body includes high and low opposite side longitudinally extending upper surfaces. The body includes a central upstanding surface extending between the high and low upper surfaces, with the latter extending transversely of the body in opposite directions from the upper and lower margins of the upstanding surface. The portion of the low upper surface adjacent the lower margin of the upstanding surface is transversely downwardly inclined theretoward, and the body includes transverse inclined passages formed therein, with the upper ends of the passages opening through the upright surface lower margin, and the lower ends of the passages opening outwardly of the longitudinal marginal portion of the body away from which the upstanding surface faces. The upper margin of the upstanding surface includes an elongated seal strip, and the upper extremity of the inclined low upper surface curves downwardly toward the lower extremity of the body, for engagement by a door lower edge mounted seal strip.

U.S. Pat. No. 5,136,814 (Headrick) discloses a draining door sill assembly with adjustable threshold cap. The draining threshold and door sill assembly has an elongated frame member forming an upwardly open channel and a sill that slopes away from the channel. A threshold cap is removably captured within the channel and protrudes slightly thereabove. An end cap is securely fastened to an end of the assembly, and is formed with a drain trough that extends transversely beneath the end of the assembly. The drain trough has a first portion that at least partially underlies the end of the channel, and extends to a mouth at the outside edge of the assembly. Rain water that seeps under the threshold cap and into the channel flows to the end of the channel and into the drain trough of the end cap, which directs the water beyond the outside edge of and away from the assembly. The threshold cap has no openings in the top thereof, and is vertically adjustable in the channel by means of a set of threaded pedestals that depend from the bottom of the threshold cap and rest on the floor of the channel. The pedestals can be threaded into and out of the threshold cap to adjust the vertical position of the cap within the channel.

U.S. Pat. No. 6,289,635 (Procton et al.) discloses a continuous handicap threshold assembly with dual dams and selectively positionable sidelight cap, in which a continuous handicap threshold assembly for an entryway has an elongated extruded aluminum body with a threshold portion, for extending continuously beneath a closed door and at least one fixed panel such as a sidelight or patio door. An exterior sill extends outwardly and slopes downwardly from the threshold portion, and an interior sill extends inwardly from the threshold portion. The threshold portion projects a small distance upwardly from the sills to define exterior and interior dams to prevent water leakage. To accommodate the fixed panel, a plastic sidelight cap is adapted to be selectively positioned along the length of the body, covering a section of the threshold portion to underlie and support the fixed panel of the entryway.

U.S. Pat. No. 5,469,665 (Biebuyck) discloses a threshold system for a door, which incorporates a seal and a threshold plate. The seal mounts to the door, and has a flap extending therebeneath. The threshold plate has a raised inner section connected to a recessed outer section by an upstanding lip. The threshold plate is disposed below the door, so that the flap of the seal contacts with the upstanding lip of the threshold plate, thereby creating a seal between an outside area and an inside area. An outer deflector is mounted on the door body to deflect air and moisture away from the threshold plate and seal.

U.S. Pat. Nos. 6,052,949 and 5,943,825 (Procton et al.) each discloses an entryway system and method, in which a modular building entryway system accommodates an active in-swinging door or an inactive sidelight panel for use with conventional jambs. Specifically, an extruded aluminum sill is mated with an extruded polymeric receiving unit. The receiving unit defines an unshaped channel, which accepts a weather strip or panel cap. Either the weather strip or the panel cap is slidably positioned within the channel under the door. Additionally, a door sweep attached to the active doors sealingly engages the weather strip, to prevent water from entering the building.

U.S. Pat. No. 4,513,536 (Giguere) discloses a weather-tight seal for the sill of a household door, which consists of two extrusions, preferably of a plastic material that is a poor conductor of heat, insuring great imperviousness, owing to automatic adjustment of the bottom portion of the door, which is freely mounted, relative to the door sill. A horizontal flange enters into a bevelled and felted groove, to guide the freely floating bottom edge of the door panel, while, at the same time, a weather strip between the bottom of the door and the sill insures perfect imperviousness.

U.S. Pat. No. 322,086 (Bartholomew) discloses a door threshold having a centrally located longitudinally extending trough and a spout connecting the trough with the lower front of the threshold.

U.S. Pat. No. 2,202,482 (Dahl) discloses a weather strip seal between a sash or door and a sill or threshold.

U.S. Pat. No. 3,851,420 (Tibbetts) discloses a weather seal arrangement around a door, which cooperates with a threshold under the door to drain away water blown against the door. Weather seals along vertical edges of the door prevent water from passing inward, and also conduct water downward to the threshold, which has an enclosed chamber under the door. The downward draining water is guided into a top opening of the chamber, preferably by pile material over the top opening, and a drain opening leads from the bottom of the chamber and empties onto the outside sill of the threshold. The top opening of the chamber is about ½" or more above the drain opening, so that wind pressure against the drain opening opposes a head of water within the chamber beneath the door.

U.S. Pat. No. 4,055,917 (Coller) discloses a door and threshold assembly, in which an inwardly swinging door is provided with a threshold assembly that substantially seals against entry of driven water and air. The threshold assembly includes a sloping sub pan having an upstanding rear wall. An integral outer threshold member and upper pan are connected to and above the sub pan. The upper pan provides a primary seal at the front edge of the door bottom, and defines a primary sill floor that cooperates with the flexible wiper blades carried by the door bottom to define secondary barriers. The inner side of the door bottom carries a final seal, which bars entry of air that may be driven through drainage holes provided in the sub pan, and interconnects the interior of the sub pan with the interior of the upper pan.

U.S. Pat. No. 4,310,991(Seely) discloses a door sealing system, in which a sealing system for an entry door incorporates a threshold member having a longitudinally extending open-ended channel in its upper surface. The sweep utilizes a double vertical seal design, which encloses the channel when the door is shut. The first seal contacts exterior portions of the channel, whereas the second seal contacts interior portions of the channel. The channel is vented through the threshold, so that the pressure on both sides of the first seal is equalized to minimize water seepage, while the second seal completely blocks the outside air from the interior of the building. The threshold is preferably of a two piece construction, which may be snapped together to thereby minimize manufacturing and installation costs.

U.S. Pat. No. 4,999,950 (Beske et al.) discloses an inwardly swinging door assembly, which includes a door member hingedly mounted to a frame. A multi-point lock engages the frame at more than one point. Weather stripping is cooperatively connected to edged surfaces. A pressure equalization member is cooperatively connected to the frame, for engaging the weather strip connected to a bottom edged surface.

U.S. Pat. No. 4,716,683 (Minter) discloses a door weather stripping assembly, which includes a first compressible weather stripping member mounted on and extending continuously around a door, with a compressible bulbous body for compressive sealing engagement between the door and a stop member of the door frame, upon closure of the door within the frame. A second flexible weather stripping member is mounted on and extends around the door forwardly of the first weather stripping member, for providing a rain screen effect upon closure of the door within the frame. The second weather stripping member includes a flexible leaf element, for frictionally engaging the stop member of the frame, upon closure of the door within the frame.

U.S. Pat. No. 6,138,413 (Fehr) discloses a standardized framing section for closure wings. A standard sized, or standard shaped profile is disclosed for use as header, sill, latch jamb and/or striker jamb portions within a framing section. In an embodiment, the top of the framing section is tapered toward one side of the section, the taper being utilized to allow for the shedding of water, snow, and the like, from the framing section, the section also including drainage ports, which extend through reinforced sections within a hollow of the framing section to provide for the draining of water away from the framing section.

U.S. Pat. No. 4,229,905 (Rush) discloses a combined door and window frame system. An elongate frame member of uniform cross-section is provided for a combined door and window frame assembly. The frame member is adapted to divide an outer perimeter frame into two areas, one to accommodate an opening window and the other to accommodate a sliding door in its closed position, and comprises a rigid supporting portion, an elongate recess of L-shaped cross-section, to receive one edge of the window, and an elongate flange connected to the supporting portion and spaced therefrom by an intervening web, the flange being so positioned, in the assembled frame, that a part of the sliding door, when closed, can engage between the flange and the supporting portion, to facilitate a substantially draught proof seal.

The door threshold water return systems discussed above are not capable of routing entrained water from the door seal into the door threshold water return system, and return the entrained water to the exterior of the home or building with substantially no water entry into the interior of the home or building. Specifically, the above mentioned door threshold water return systems are not capable of directing water to enter the door threshold water return system from the interior side of the system to the exterior side of the system, and out towards the door system in a direction opposing increasing air pressure and opposing air flow, thereby forcing water to flow out of the system in a direction of increasing pressure.

It is an object of the present invention to provide door threshold water return systems that overcome the aforementioned disadvantages and problems.

SUMMARY OF THE INVENTION

The present invention provides a door threshold water return system for preventing water entrained in higher pressure air at exterior of homes and buildings from entering interior of the homes or buildings during storm or wind driven rain, ice, hail, or snow events.

The inventive door threshold water return system can be used with a variety of types, sizes, and shapes of doors, door systems, door assemblies, door frames, jambs, homes, buildings, and the like. The inventive system can be installed in a quick, convenient, and efficient manner, and is easy and safe to use, attractive, sturdy, of simple construction, inexpensive to manufacture, durable, and long lasting. In addition, the inventive system can maintain its ability to return water that entered the system to the outside environment during storm events and prevent drafts over time, even in situations where repeated opening and closing of the door is necessary.

The inventive door threshold water return system, which can be used with existing door systems, directs water to enter the system from an interior side of the system and to exit from an exterior side of the system, towards a direction opposing increasing air pressure and air flow, thereby forcing water to flow out of the system in a direction of increasing air pressure. Since air flow is minimized through the inventive system, substantially all water entering the system from the interior side is returned to the exterior side, thereby preventing unwanted drafts.

The inventive door threshold water return system has a high degree of structural integrity, and is capable of use in a variety of situations. For example, in one embodiment, the system is provided with a sill angle to facilitate easy wheel chair ingress and egress.

In one embodiment, the inventive door threshold water return system comprises a lower sill, an upper sill, a rear wall, and a front wall forming a chamber, wherein at least one generally arcuately shaped baffle is provided projecting into the chamber from the rear wall. A first gap is provided in proximity to the rear wall and between the upper sill and the rear wall, and a second gap is provided in proximity to the lower sill and between the lower sill and the front wall, whereby water introduced into the inventive system through the first gap exits the system through the second gap. In this embodiment, the upper sill is inclined relative to the lower sill, and the upper sill and the front wall are integral and form an arcuate corner. Further, the system may additionally be provided with a first stage, having at least one aperture therein, that divides the chamber.

In another embodiment, the inventive door threshold water return system comprises a lower sill, an upper sill, a rear wall, a front wall, and at least two stages forming multiple chambers, wherein at least one baffle is provided projecting from the rear wall. A first gap is provided in proximity to the rear wall and between the upper sill and the rear wall, a second gap is provided in proximity to the lower sill and between the lower sill and the front wall, and at least three internal chambers are in fluid communication with each other and with the first and second gaps. The first and second stages are generally perpendicular to the lower sill. The three internal chambers are formed by a first stage having at least one lower aperture and a second stage having at least one lower aperture and at least one upper aperture. The sum of cross sectional areas of the lower aperture and the upper aperture of the second stage is larger than the cross sectional area of the lower aperture of the first stage. In this embodiment, the system may additionally be provided with a protrusion connected to the lower sill and is in proximity to the second stage.

In yet another embodiment, the inventive door threshold water return system comprises a lower sill, an upper sill, a rear wall, a front wall, and at least three stages forming multiple chambers, wherein at least one baffle is provided projecting from the rear wall. A first gap is provided in proximity to the rear wall and between the upper sill and the rear wall, a second gap is provided in proximity to the lower sill and between the lower sill and the front wall, and at least four internal chambers are in fluid communication with each other and with the first and second gaps. The four internal chambers are formed by a first stage having at least one lower aperture, a second stage having at least one lower aperture, and a third stage having at least one lower aperture and at least one upper aperture. All three stages contact the upper sill and the lower sill of the system. In this embodiment, the cross sectional area of the at least one lower aperture of the second stage is larger than the cross sectional area of the at least one lower aperture of the first stage, and the sum of cross sectional areas of the at least one lower aperture and the at least one upper aperture of the third stage is larger than the cross sectional area of the at least one lower aperture of the first stage. In one example of the present embodiment, the total cross sectional area of the at least one lower aperture of the first stage is about 0.11 square inch; the total cross sectional area of the at least one lower aperture of the second stage is about 2.0 square inches; and the total cross sectional areas of the at least one lower aperture and the at least one upper aperture of the third stage is about 1.8 square inches.

In the above embodiment, the first chamber is defined by the third stage, the rear wall, the upper sill, and the lower sill; the second chamber is defined by the second stage, the third stage, the upper sill, and the lower sill; the third chamber is defined by the first stage, the second stage, the upper sill, and the lower sill; and the fourth chamber is defined by the front wall, the first stage, the upper sill, and the lower sill.

BRIEF DESCRIPTION OF THE DRAWINGS

The present invention will be described in greater detail in the following detailed description, with reference to the accompanying drawings, wherein:

FIG. 13A shows a cross sectional view of the door threshold water return system of FIG. 1, during a step of the method shown in FIG. 12;

FIG. 13B shows a cross sectional view of the door threshold water return system of FIG. 1, during another step of the method shown in FIG. 12;

DETAILED DESCRIPTION OF THE INVENTION

The present invention provides systems and methods for preventing water entrained in higher pressure air at exterior of homes and buildings from entering interior of the homes or buildings. The inventive door threshold water return system can generally be used with a variety of types, sizes, and shapes of doors, door systems, door assemblies, door frames, jambs, homes, buildings, and the like. The system can be installed in a quick, convenient, and efficient manner, and is easy and safe to use, attractive, sturdy, of simple construction, inexpensive to manufacture, durable, and long lasting. In addition, the system can maintain its ability to return water entering the system to outside environment during storm events and prevent drafts over time, even in situations where repeated opening and closing of the door is necessary.

The inventive door threshold water return system, which can be used with existing door systems, directs water to enter the system from an interior side of the system and to exit from an exterior side of the system, towards a direction opposing increasing air pressure and air flow, thereby forcing water to flow out of the system in a direction of increasing air pressure. Since air flow is minimized through the inventive system, substantially all water entering the system from the interior side is returned to the exterior side, thereby preventing unwanted drafts.

Figure 1:
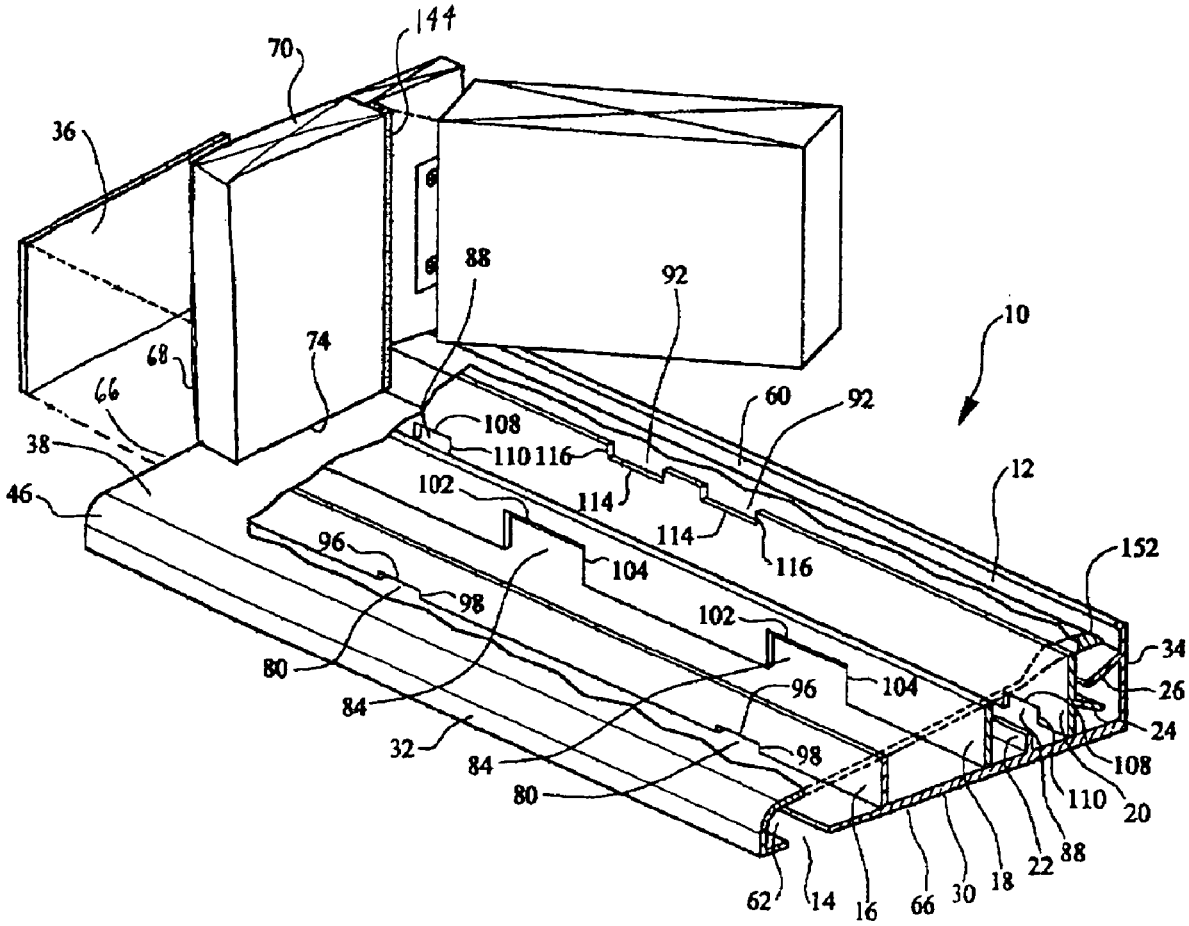
FIG. 1 is a cutaway perspective view of an embodiment of the inventive door threshold water return system.

FIG. 1 shows an embodiment of the inventive door threshold water return system 10. The system comprises a first stage 16, a second stage 18, a third stage 20, a protrusion or a water dam 22, a first baffle 24, a second baffle 26, an upper sill 28, a lower sill 30, a nose or a front wall 32, a rear wall 34, and end plates 36. The system 10 is also provided with a first gap or water inlet 12, which also serves as a low pressure side air outlet, and a second gap or water outlet 14, which also serves as a high pressure side air inlet.

Figure 6:
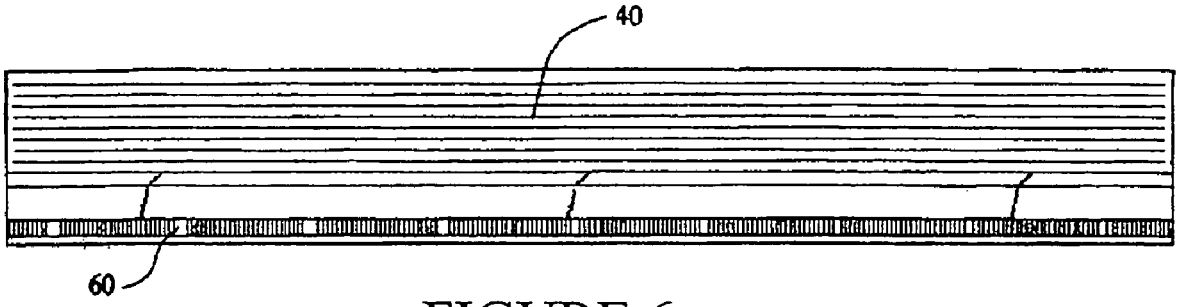
FIG. 6 is a top view of the door threshold water return system of FIG. 1.
Figure 7:
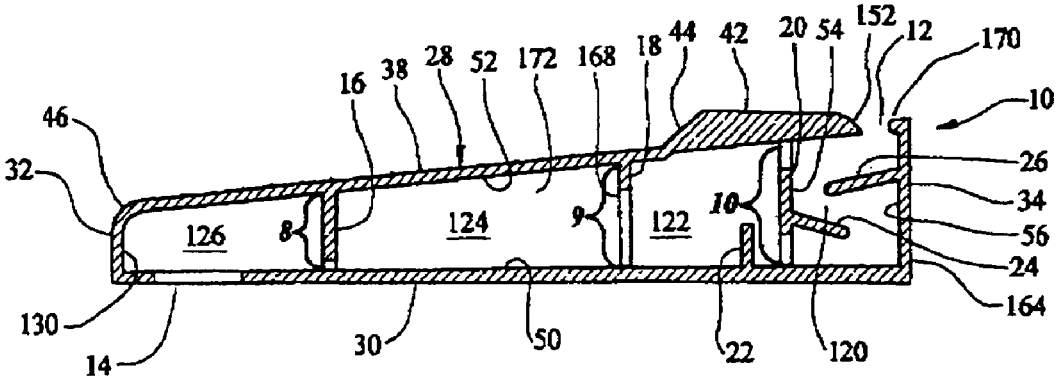
FIG. 7 is a cross sectional view of the door threshold water return system of FIG. 1.
Figure 8:
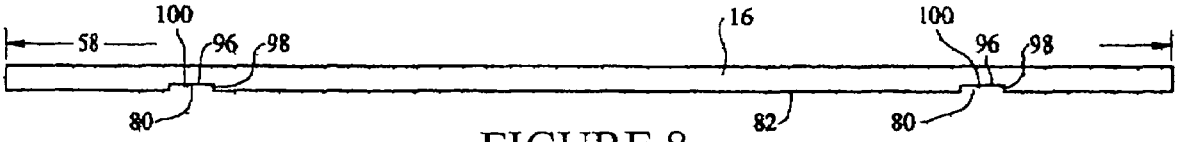
FIG. 8 is a front view of a first stage of the door threshold water return system of FIG. 1.
Figure 9:
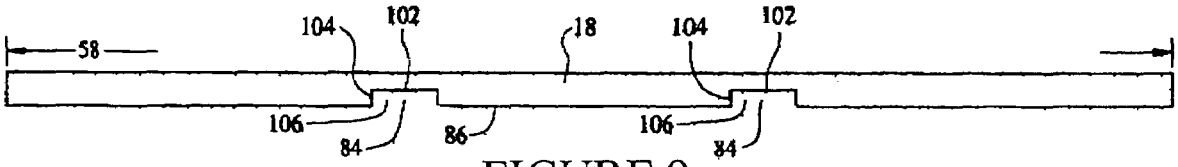
FIG. 9 is a front view of a second stage of the door threshold water return system of FIG. 1.
Figure 10:
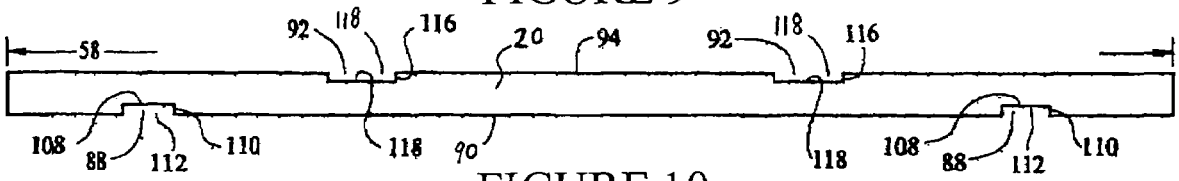
FIG. 10 is a front view of a third stage of the door threshold water return system of FIG. 1.
Figure 11:
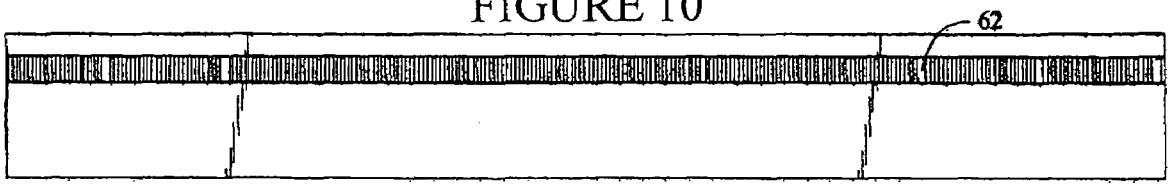
FIG. 11 is a bottom view of the door threshold water return system of FIG. 1.

As shown in FIG. 7, the upper sill 28 has an inclined sill portion 38, which typically has transverse anti slip surface 40 (shown in FIG. 6), and a step 42 with an inclined riser 44. The inclined sill portion 38 is upwardly inclined toward the rear wall 34, and the front wall or nose 32 and the inclined sill portion 38 are connected at an arcuate corner 46.

The first stage 16, the second stage 18, and the third stage 20 are each substantially perpendicularly connected to interior 50 of the lower sill 30 and transversely connected to interior 52 of the upper sill 28. The protrusion or water dam 22 is also substantially perpendicularly connected to the interior 50 of the lower sill 30. The first baffle 24 is connected to rear 54 of the third stage 20, and is downwardly inclined toward the rear wall 34. The second baffle 26 is connected to front 56 of the rear wall 34, and is downwardly inclined toward the third stage 20. In this embodiment, the second baffle 26 is located above the first baffle 24.

The upper sill 28, the lower sill 30, the front wall 32, and the rear wall 34 each have substantially the same length 58. As shown in FIG. 1, the water inlet 12, which also serves as a low pressure side air outlet, is provided with channel 60 and the water outlet 14, which also serves as a high pressure side air outlet, is provided with channel 62. Both inlet 12 and outlet 14 extend length 58. The system 10 may further be provided with end plates 36 sealably connected to ends 66 and sides 68 of door jambs 70, with the upper sill 28 beneath and adjacent bottom 74 of door jambs 70. The end plates 36 may be fused, fastened, or chemically bonded to the ends 66 of the system 10, although any other suitable connecting means may be used. End plates 36 may have the same profile as ends 66 and or different profile from ends 66. End plates 36 may be constructed of any suitable foam material, such as injectable and expandable foam, any suitable metal, such as aluminum, and any suitable gasket material, combinations thereof, and the like.

Figure 2:
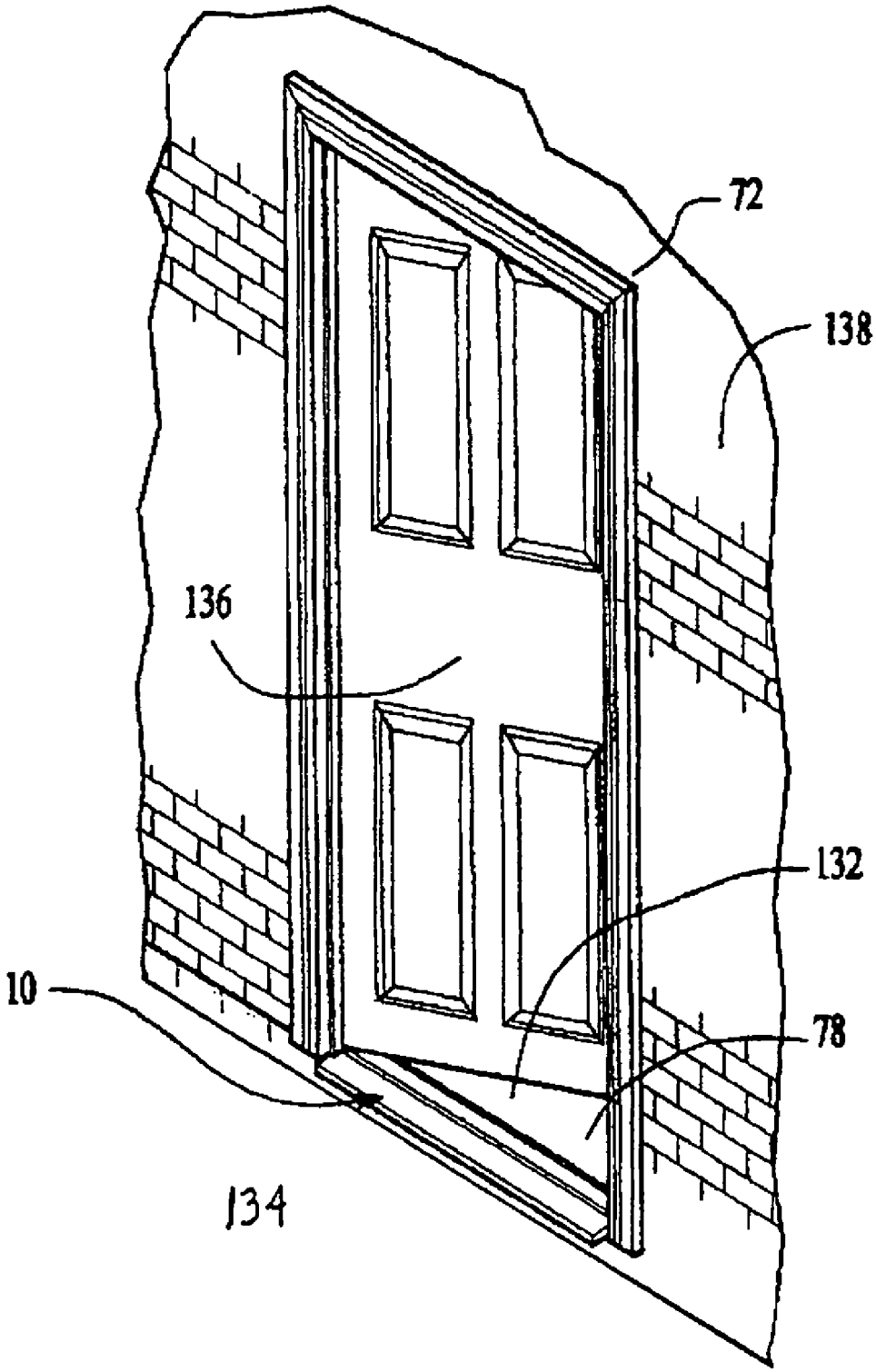
FIG. 2 is a perspective view of the door threshold water return system of FIG. 1 installed in a residential building.
Figure 3:
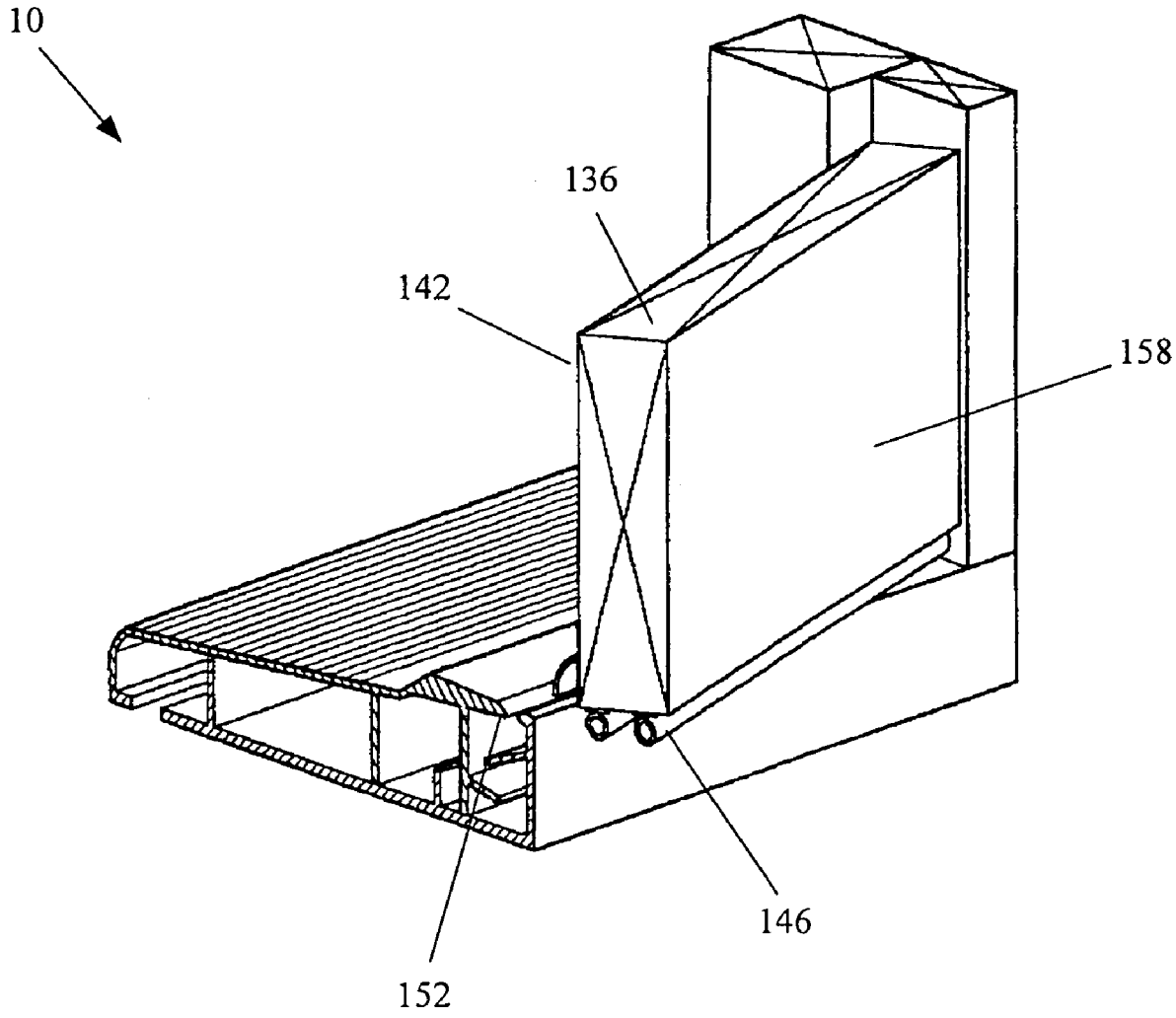
FIG. 3 is a cutaway perspective view of the door threshold water return system of FIG. 1 installed beneath an exterior door and a jamb, showing the exterior door partially open.

FIG. 2 shows the door threshold return system 10 installed to a door frame 72. The lower sill 30 of the system 10 is mounted to sill 78 at the bottom of the door frame 72, with the channel 62 extending outwardly beyond the sill 78 of the door frame 72, thus, facilitating water to be discharged from the water outlet 14.

As shown in FIGS. 6 and 7, the upper sill 28, which is provided with inclined sill portion 38, the transverse anti slip surface 40, the step 42 with the inclined riser 44, the arcuate corner 46, and the front wall 32, facilitate easy wheel chair ingress and egress to and from homes and buildings with the door threshold water return system 10 is installed upon.

As shown in FIGS. 1, 8, 9, and 10, the first stage 16 has opposing first stage lower apertures 80 at bottom 82 of the first stage 16. The second stage 18 has opposing second stage lower apertures 84 at bottom 86 of the second stage 18. The third stage 20 has opposing third stage lower apertures 88 at bottom 90 of the third stage 20 and opposing third stage upper apertures 92 at top 94 of the third stage 20. The opposing first stage lower apertures 80, the opposing second stage lower apertures 84, the opposing third stage lower apertures 88, and the opposing third stage upper apertures 92 are generally offset one from the other, although other suitable configurations may be used.

Each of the opposing first stage lower apertures 80 has length 96, height 98, and cross sectional area 100, which is equal to the length 96 multiplied by the height 98. Each of the opposing second stage lower apertures 84 has length 102, height 104, and cross sectional area 106, which is equal to the length 102 multiplied by the height 104. Each of the opposing third stage lower apertures 88 has length 108, height 110, and cross sectional area 112, which is equal to the length 108 multiplied by the height 110. Each of the opposing third stage upper apertures 92 has length 114, height 116, and cross sectional area 118, which is equal to the length 114 multiplied by the height 116.

As shown in FIG. 7, the door threshold water return system 10 is provided with first chamber 120, second chamber 122, third chamber 124, and fourth chamber 126. The first chamber 120 is defined by the interior 52 of the upper sill 28, and the interior 50 of the lower sill 30, the third stage 20, and the front 56 of the rear wall 34. The second chamber 122 is defined by the second stage 18, the third stage 20, the interior 52 of the upper sill 28, and the interior 50 of the lower sill 30. The third chamber 124 is defined by the first stage 16, the second stage 18, the interior 52 of the upper sill 28, and the interior 50 of the lower sill 30. The fourth chamber 126 is bounded by interior 130 of the front wall 32, the first stage 16, the interior 52 of the upper sill 28, and the interior 50 of the lower sill 30.

The first chamber 120 is partially open to indoor environment 132 at the water inlet 12, which also serves as a low pressure side air outlet. The first chamber 120 is also open to the second chamber 122 at the opposing third stage lower apertures 88 and the opposing third stage upper apertures 92. The second chamber 122 is partially open to the third chamber 124 at the opposing second stage lower apertures 84. The third chamber 124 is partially open to the fourth chamber 126 at the opposing first stage lower apertures 80. The fourth chamber 126 is partially open to outdoor environment 134 at the water outlet 14, which also serves as a high pressure side air inlet.

Figure 4:
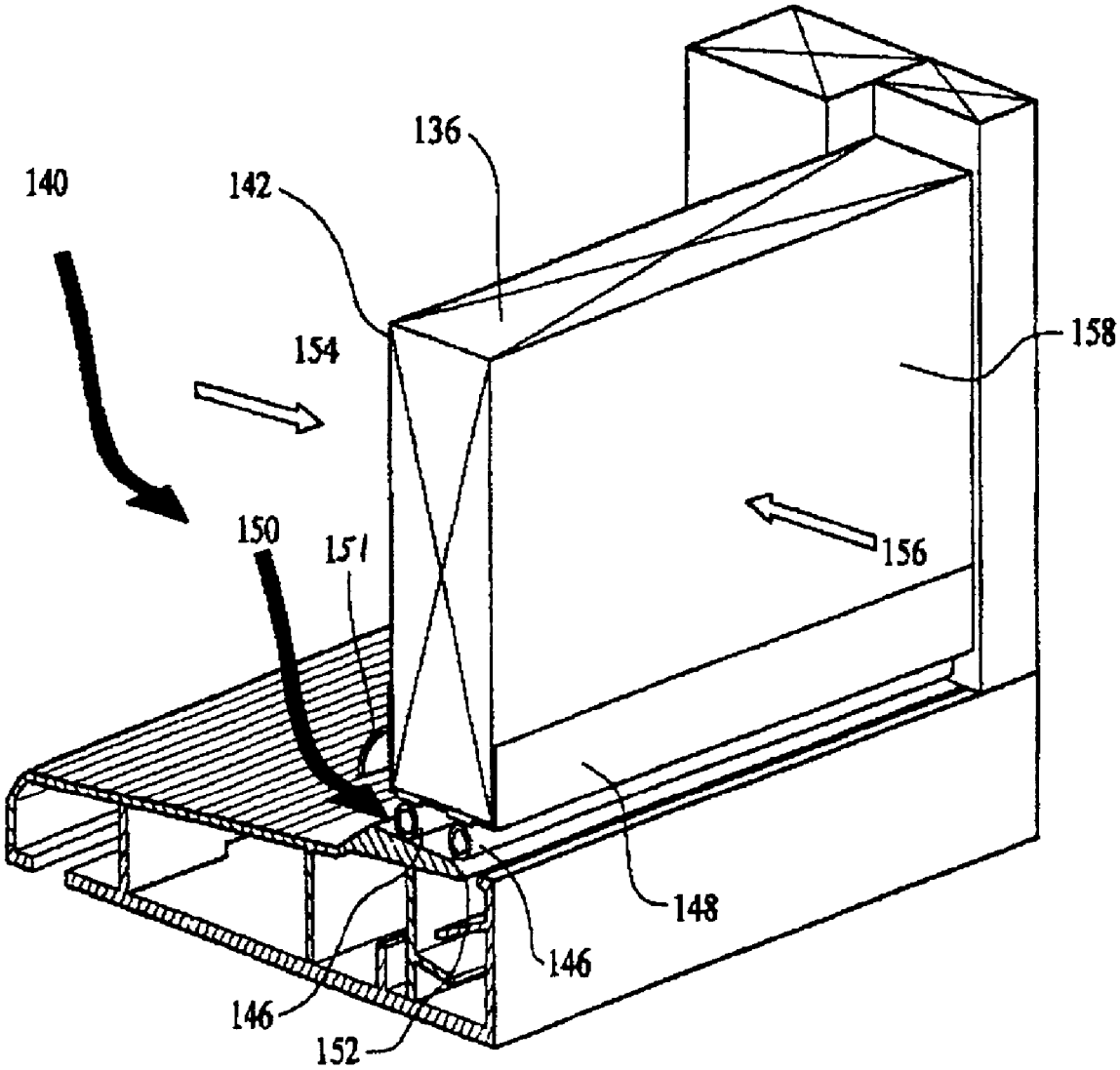
FIG. 4 is a cutaway perspective view of the door threshold water return system of FIG. 1 installed beneath an exterior door and a jamb, showing the exterior door of FIG. 3 closed.
Figure 5:
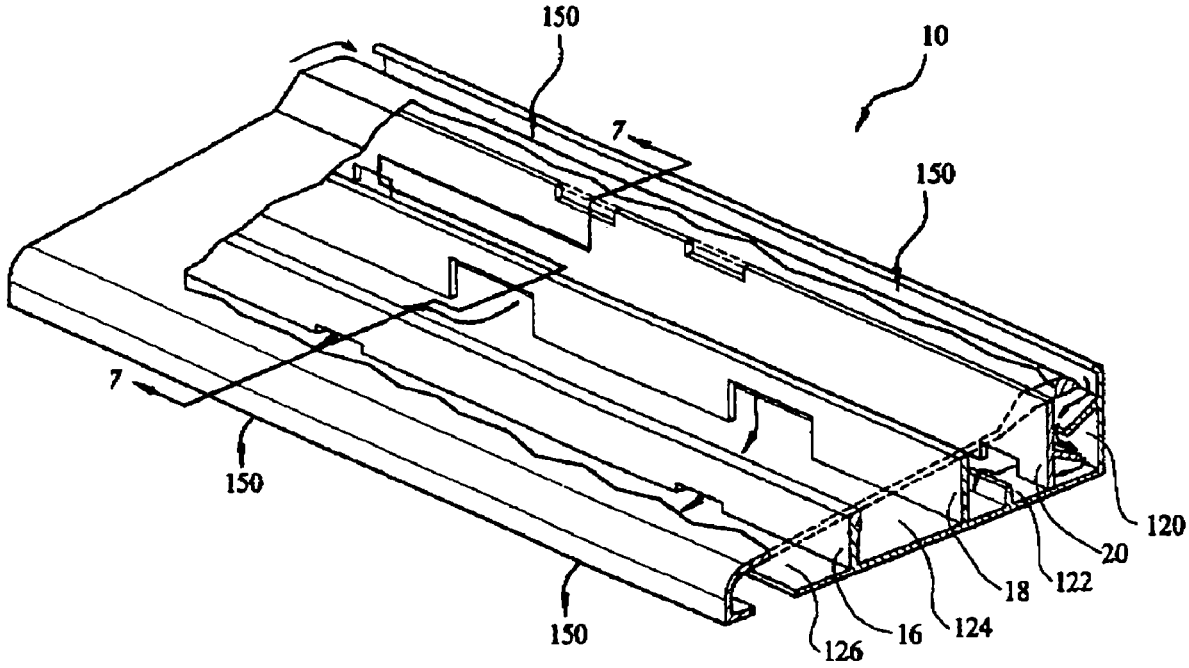
FIG. 5 is a cutaway perspective view of the door threshold water return system of FIG. 1, showing a water return path.

As shown in FIGS. 2 and 4, the door threshold water return system 10 functions as a self draining door threshold for an exterior door 136 of a residential building 138. When wind driven rain 140 impinges on exterior face 142 of the exterior door 136, imperfect door seals 144 and 146 of door shoe 148 of the exterior door 136 cause water 150 to be introduced at shoulder 152 of the upper sill 28 into the water inlet 12, and into the first chamber 120 of the door threshold water return system 10. Drip edge 151 is also shown in FIG. 4.

The water 150 introduced into the first chamber 120 via the water inlet 12 of the door threshold water return system 10 flows through the second and third chambers 122 and 124, respectively, and into the fourth chamber 126, where the water 150 exits the water outlet 14 of the door threshold water return system 10. Wind impingement from the exterior face 142 of the exterior door 136 causes an air pressure differential to be exerted across the door threshold water return system 10, with higher pressure 154 exerted on the exterior face 142 of the exterior door 136 and the fourth chamber 126, and lower air pressure 156 exerted on interior face 158 of the exterior door 136 and the first chamber 120. This air pressure differential opposes the movement of water from the fist chamber 120 to the fourth chamber 126.

Performance of the door threshold water return system 10 is related to the multiple chamber design, i.e., the first chamber 120, the second chamber 122, the third chamber 124, and the fourth chamber 126, the relationship of the aperture sizes one to the other, i.e., the cross sectional areas 100 of the opposing first stage lower apertures 80, the cross sectional areas 106 of the opposing second stage lower apertures 84, the cross sectional areas 112 of the opposing third stage lower apertures 88, and the cross sectional areas 118 of the opposing third stage upper apertures 92 relative one to the other, and the placement of the apertures relative one to the other, the vertical placement of the apertures typically having a greater affect than the horizontal placement of the apertures.

In particular, the size and placement of the apertures in the stages between adjacent chambers plays a key role in achieving the required air pressure differentials between and across the chambers, in order for water to flow in the direction of opposing air pressure. The door threshold water return system 10, then, facilitates the flow of water, which is introduced into the first chamber 120 via the water inlet 12 of the door threshold water return system 10, to move from the first chamber 120 through the second and third chambers 122 and 124, respectively, and into the fourth chamber 126, to exit the door threshold water return system 10 at the water outlet 14, while the air pressure is higher at the water outlet 14 than the air, pressure at the water inlet 12.

It is the relative cross sectional areas of the apertures that results in the desired water drainage performance. In one embodiment, the ratio of the cross sectional area 106 of the opposing second stage lower apertures 84 to the cross sectional area 100 of the opposing first stage lower apertures 80, is approximately $2.0/0.11 \approx 18$. This particular ratio is not necessarily unique. Other suitable aperture cross sectional area ratios may be used. The primary requirement is that the ratio of the cross sectional area 106 of the opposing second stage lower apertures 84 to the cross sectional area 100 of the opposing first stage lower apertures 80 be relatively large. Similar performance could very well be achieved with cross sectional area ratios as small as 5 up to a substantially larger ratio. In the present embodiment, the ratio of the sum of the cross sectional areas 112 plus 118 of the opposing third stage lower apertures 88 and the opposing third stage upper apertures 92, respectively, to the cross sectional areas 100 of the opposing first stage lower apertures 80, is approximately $1.8/0.11 \approx 16$. Again, this particular ratio is not necessarily unique, and, again, other suitable aperture ratios may be used. The primary requirement is that the ratio of the sum of the cross sectional areas 112 plus 118 of the opposing third stage lower apertures 88 and the opposing third stage upper apertures 92, respectively, to the cross sectional area 100 of the opposing first stage lower apertures 80 be relatively large. Again, similar performance could very well be achieved with cross sectional area ratios as small as 5 up to a substantially larger ratio.

The absolute size of the opposing first stage lower apertures 80 is, however, important for restricting air flow through the door threshold water return system 10. The total cross sectional areas 100 of the opposing first stage lower apertures 80 was chosen, so that the entire door system, i.e., the exterior door 136 and the door threshold water return system 10 would meet air flow requirements specified in the North American Fenestration Standard AAMA 101.I.S2-A440, although other suitable design requirements may be used. In this instance, the sum of the cross sectional areas 100 of the opposing first stage lower apertures 80 is approximately 0.11 square inch, although other suitable aperture cross sectional areas may be used.

In the present embodiment, the total cross sectional areas in each stage is as follows: $A1 \approx 0.11$ sq. inch (where A1 is the sum of the cross sectional areas 100 of the opposing first stage lower apertures 80), A2≈2.0 sq. inches (where A2 is the sum of the cross sectional areas 106 of the opposing second stage lower apertures 84), and A3≈1.8 sq. inches (where A3 is the sum of the cross sectional areas 112 of the opposing third stage lower apertures 88 plus the cross sectional areas 118 of the opposing third stage upper apertures 92, respectively). Again, other suitable aperture cross sectional areas may be used.

The hydrostatic pressure of water is:

$$P_W=\rho_w*g*h$$

where ρw is the density of water, g is the acceleration due to gravity, and h is the height of water.

In general, water will flow through the door threshold water return system 10 toward the water outlet 14 of the door threshold water return system when:

$$P_W>P_A$$

where $P_A$ is the static air pressure in the adjacent chamber.

Air flow is steady prior to water entering into the door threshold water return system 10. The air pressure distribution through the door threshold water return system 10 can be predicted using the following energy equation for steady incompressible flow:

$$P_E/(\rho g)=P_D/(\rho g)+h_{L1}=P_C/(\rho g)+h_{L1}+h_{L2}=P_B/(\rho g)+h_{L1}+h_{L2}+h_{L3} \quad (1)$$

where $P_E$ is the static air pressure in the fourth chamber 126, $P_D$ is the static air pressure in the third chamber 124, $P_C$ is the static air pressure in the second chamber 122, and $P_B$ is the static air pressure in the first chamber 120.

In addition, $h_{L1}$ is the head loss due to air flow through the opposing first stage lower apertures 80, $h_{L2}$ is the head loss due to air flow through the opposing second stage lower apertures 84, and $h_{L3}$ is the head loss due to air flow through the opposing third stage lower apertures 88 and the opposing third stage upper apertures 92. Finally, ρ is the density of air at standard conditions and g is the acceleration due to gravity.

The head loss between any two adjacent chambers can be predicted as follows:

$$h_L=K_LV^2/(2g)$$

where $K_L$ is the loss coefficient and V is the average air velocity through the apertures for the particular stage under consideration.

For each of the three stages, i.e., the first stage 16, the second stage 18, and the third stage 20, the air moves through relatively small apertures, i.e., the opposing first stage lower apertures 80, the opposing second stage lower apertures 84, the opposing third stage lower apertures 88, and the opposing third stage upper apertures 92, which represent both a sudden contraction and sudden expansion and a total loss coefficient of substantially $K_L$=1.5. Therefore, the head losses for the first stage 16, the second stage 18, and the third stage 20, respectively are substantially:

$$h_{L1}=1.5V_1^2/(2g), \quad (2a)$$

$$h_{L2}=1.5V_2^2/(2g), \quad (2b)$$

$$h_{L3}=1.5V_3^a/(2g), \quad (2c)$$

where $V_1$ is the average air velocity through the opposing first stage lower apertures 80, $V_2$ is the average air velocity through the opposing second stage lower apertures 84, and $V_3$ is the average air velocity through the opposing third stage lower apertures 88 and the opposing third stage upper apertures 92.

Under steady air flow conditions, the volumetric flow of air through the opposing first stage lower apertures 80 is substantially equivalent to the volumetric flow of air through the opposing second stage lower apertures 84, which is also substantially equivalent to the sum of the volumetric flow of air through the opposing third stage lower apertures 88 plus the opposing third stage upper apertures 92. Therefore:

$$A_1V_1=A_2V_2=A_3V_3, \quad (3)$$

where $A_1$ is the sum of the cross sectional areas 100 of the opposing first stage lower apertures 80, $A_2$ is the sum of the cross sectional areas 106 of the opposing second stage lower apertures 84, and $A_3$ is the sum of the cross sectional areas 112 plus 118 of the opposing third stage lower apertures 88 and the opposing third stage upper apertures 92, respectively.

Combining equations 1, 2, and 3 yields the following expressions for $P_D$ and $P_C$:

$$P_D=P_E-(P_E-P_B)/[1+(A_1/A_2)^2+(A_1/A_3)^2],$$

$$P_C=P_B+(P_E-P_B)/[1+(A_3/A_1)^2+(A_3/A_2)^2],$$

where $P_E$ is the higher air pressure 154 of the outdoor environment 134 of the door threshold water return system 10, and $P_B$ is the lower air pressure 156 of the interior environment 132.

Typical performance and design values are discussed below for the door threshold water return system 10, although other suitable performance requirements and/or design values may be used.

When, for example, a typical wind speed of approximately 35 miles per hour is chosen as a performance requirement, a static pressure differential ($P_E-P_B$) of approximately 3.1 pounds per square foot results across the door threshold water return system 10.

Under these conditions, then, the door threshold water return system 10 allows water introduced into the first chamber 120 via the water inlet 12 of the door threshold water return system 10 to move from the first chamber 120 through the second and third chambers 122 and 124, respectively, and into the fourth chamber 126, where the water 150 exits the water outlet 14 of the door threshold water return system 10, when an air pressure difference equal to or less than 3.1 psf (pounds per square foot) is exerted across the door threshold water return system 10, owing to wind driven rain, caused by a wind speed of approximately 35 mph. The introduction of water introduced at the shoulder 152 of the upper sill 28 into the water inlet 12, and into the first chamber 120 of the door threshold water return system 10 occurs with substantially no ingress of water from the first chamber 120 to the interior environment 134. Substantially all water introduced into the door threshold water return system 10 system exits the door threshold water return system 10 through the water outlet 14.

In the present embodiment, the length 96 of each of the opposing first stage lower apertures 80 is ⅞th inch long, and the height 98 of each of the opposing first stage lower apertures 80 is 1/16th inch high. The length 102 of each of the opposing second stage lower apertures 84 is 2 inches long, and the height 104 of each of the opposing second stage lower apertures 84 is ½ inch high. The length 108 of each of the opposing third stage lower apertures 88 is 1 and ¾ inches long, and the height 110 of each of the opposing third stage lower apertures 88 is 3/16th inch high. The length 114 of each of the opposing third stage upper apertures 92 is 2 and ¼ inch long, and the height 116 of each of the opposing third stage upper apertures 92 is ¼ inch high. Each of the lengths and heights are approximate.

Certain features of the door threshold water return system 10 include:

1) A multiple chamber design used to create very low gauge air pressure in the regions of the sill where water is initially introduced. This allows water to flow freely through the first three regions (the first chamber 120, the second chamber 122, and the third chamber 124);

2) In the first two regions (the first chamber 120 and the second chamber 122) where water is initially introduced into the door threshold water return system 10, the flow of air is directed well above the water level, preventing the flow of air through the water. This is achieved by the water dam 22 at the interior of the second chamber 122, which allows water to accumulate and block the flow of air through the opposing third stage lower apertures 88;

3) During the initial period, when air flows through the opposing third stage lower apertures 88, the first baffle 24 and the second baffle 26 in the first chamber 120 prevent entrainment and ejection of water from the first chamber 120 to the interior environment 132;

4) When the water level in the door threshold water return system 10 is sufficiently high, the placement of the opposing second stage lower apertures 84 causes the air flow to stop. This eliminates the possibility of water entrainment and ejection from the first chamber 120 to the interior environment 132;

5) As water continues to accumulate in the door threshold water return system 10, the total head pressure in the third chamber 122 increases until the head pressure exceeds the air pressure 154 of the exterior environment 134. This allows water to exit the door threshold water return system 10.

The door threshold water return system 10 other than the end plates 64 is typically of extruded construction, although other suitable construction may be used. The door threshold water return system 10 may be of metal, such as aluminum or steel, thermoplastics, thermosetting polymers, rubber, or other suitable material or combinations thereof.

Figure 12:
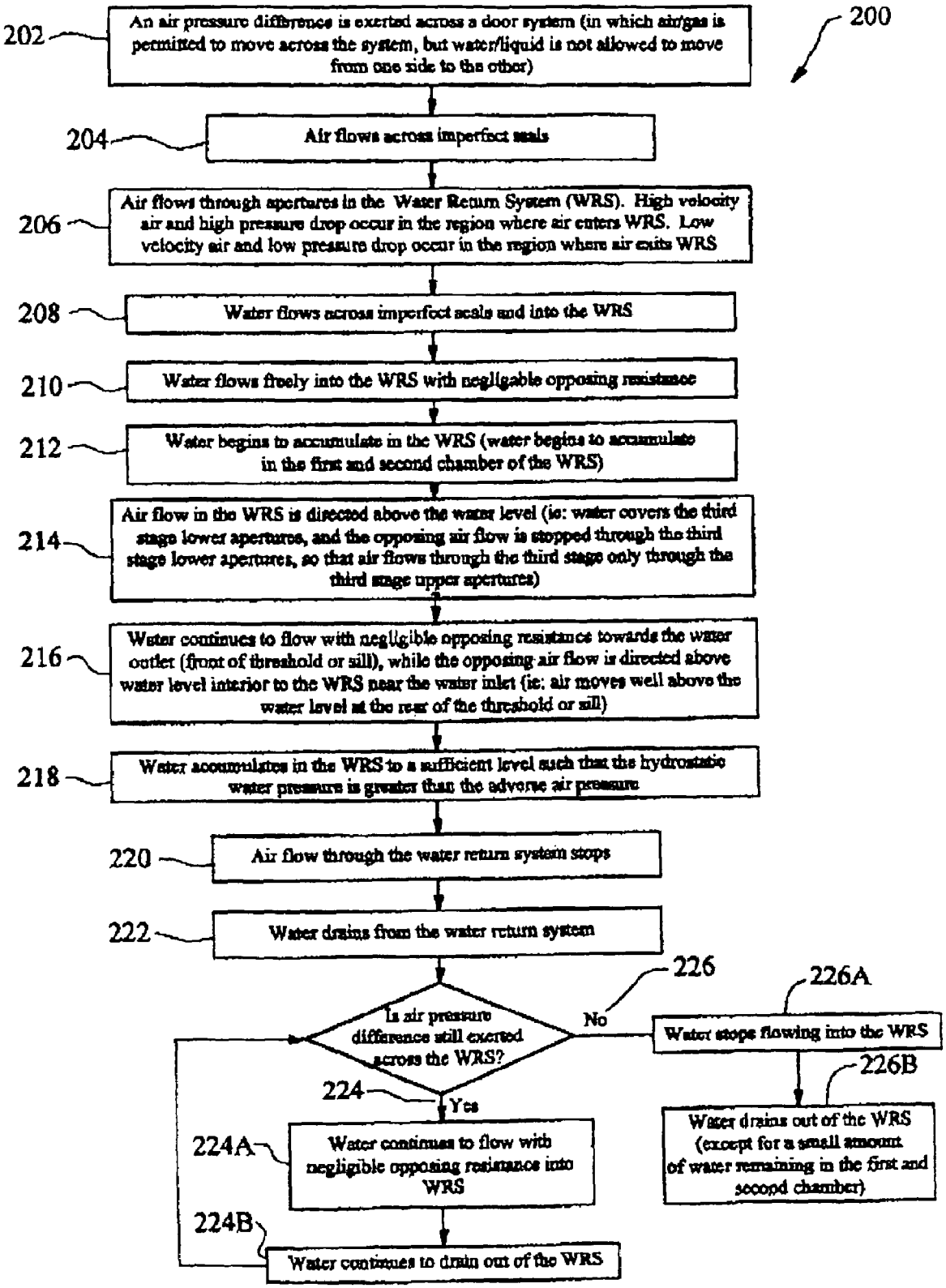
FIG. 12 shows steps of a method of the door threshold water return system of FIG. 1.

FIG. 12 shows steps of the method 200 of the present invention, the door threshold water return system 10, which is more generally considered to be a water return system (WRS), as follows:

(202) An air pressure difference is exerted across a door system (in which air/gas is permitted to move across the system, but water/liquid is not allowed to move from one side to the other);

(204) Air flows across imperfect seals;

(206) Air flows through apertures in the water return system; High velocity air and high pressure drop occur in the region where air enters water return system; Low velocity air and low pressure drop occur in the region where air exits the water return system;

(208) Water flows across imperfect seals and into the water return system;

(210) Water flows freely into the water return system with negligible opposing resistance;

(212) Water begins to accumulate in the water return system (water begins to accumulate in the first chamber and the second chamber of the water return system);

(214) Air flow in the water return system is directed above the water level (i.e., water covers the third stage lower apertures, and the opposing air flow is stopped through the third stage lower apertures, so that in the third stage, air flows only through the third stage upper apertures);

(216) Water continues to flow with negligible opposing resistance towards the water outlet (front of the threshold or sill), while the opposing air flow is directed above the water level interior to the water return system near the water inlet (i.e. air moves well above the water level at the rear of the threshold or sill);

(218) Water accumulates in the water return system to a sufficient level such that the hydrostatic water pressure is greater than the adverse air pressure;

(220) Air flow through the water return system stops;

(222) Water drains from the water return system;

(224) If there is an air pressure difference still exerted across water return system, then:

(224A) Water continues to flow with negligible opposing resistance into water return system;

(224B) Water continues to drain out of the water return system;

(226) If there is not an air pressure difference still exerted across water return system, then:

(226A) Water stops flowing into water return system;

(226B) Water drains out of the water return system (except for a small amount of water remaining in the first chamber and the second chamber).

FIGS. 13A-13H show the behavior of air and water entering and leaving the door threshold water return system 10, corresponding to certain steps of the method 200 of the present invention, shown in FIG. 12. FIGS. 13A-13H are discussed below, using the previously described typical air pressure difference equal to or less than 3.1 psf (pounds per square foot) exerted across the door threshold water return system 10, owing to wind driven rain, caused by a wind speed of approximately 35 mph, although other suitable values may be used, and the typical dimensions previously discussed, although other suitable dimensions may be used.

Initially, as shown in FIG. 13A, when there is no water in any of the chambers of the door threshold water return system 10, air is free to flow through all of the apertures of the door threshold water return system 10, i.e., the opposing first stage lower apertures 80, the opposing second stage lower apertures 84, the opposing third stage lower apertures 88, and the opposing third stage upper apertures 92.

For an overall air pressure differential of $P_E-P_B=3.1$ psf, the predicted air pressures (gauge) $P_E$, $P_D$, $P_C$, $P_B$, in the fourth chamber 126, the third chamber 124, the second chamber 122, and first chamber 120, respectively, are as follows:

$$P_E \approx 3.10 \text{ psf} \approx 0.595 \text{ inches water column (WC)}$$

$$P_D \approx 0.02 \text{ psf} \approx 0.004 \text{ inches WC}$$

$$P_C \approx 0.01 \text{ psf} \approx 0.002 \text{ inches WC}$$

$$P_B \approx 0.00 \text{ psf} \approx 0.000 \text{ inches WC}$$

This air pressure distribution in the door threshold water return system 10 results from the relative size of the opposing first stage lower apertures 80, the opposing second stage lower apertures 84, the opposing third stage lower apertures 88, and the opposing third-stage upper apertures 92 one to the other. For the specified aperture sizes, A1=0.11 sq. inch, A2≈2.0 sq. inches, and A3≈1.8 sq. inches, where A1 is the sum of the cross sectional areas 100 of the opposing first stage lower apertures 80, A2 is the sum of the cross sectional areas 106 of the opposing second stage lower apertures 84, and A3 is the sum of the cross sectional areas 112 plus 118 of the opposing third stage lower apertures 88 and the opposing third stage upper apertures 92, respectively.

Owing to the relatively small cross sectional area of the opposing first stage lower apertures 80, the largest pressure drop occurs from the fourth chamber 126 to the third chamber 124, which results in very low gauge air pressures in the first chamber 120, the second chamber 122, and the third chamber 124, and allows water to flow with relative ease through the first chamber 120, the second chamber 122, and the third chamber 124.

Figure 13C:
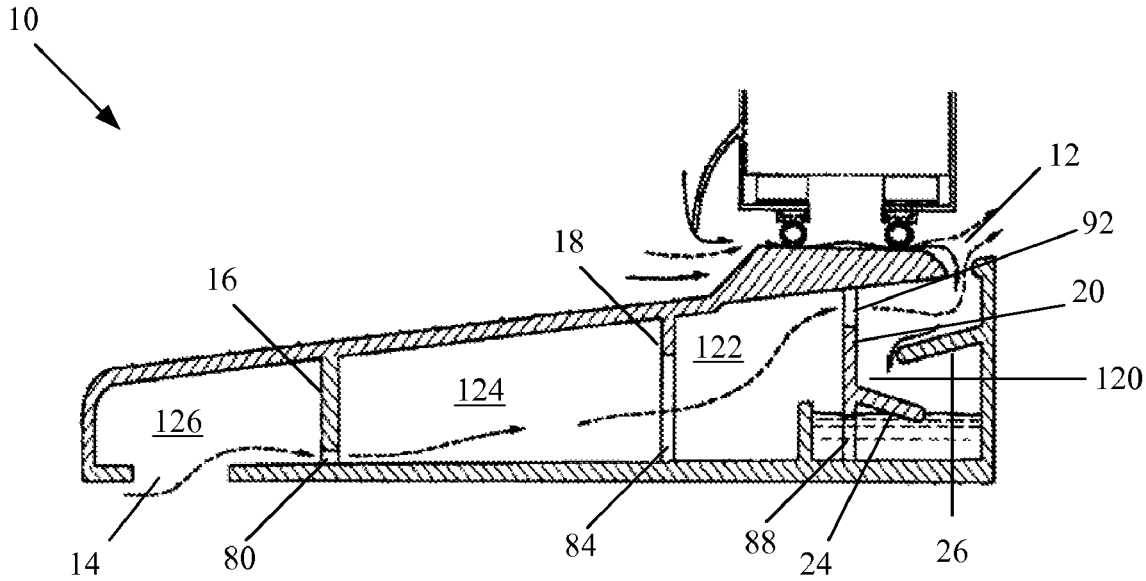
FIG. 13C shows a cross sectional view of the door threshold water return system of FIG. 1, during another step of the method shown in FIG. 12.

As water begins to fill the first chamber 120, the water passes through the opposing third stage lower apertures 88. The water dam 22 in the second chamber 122 causes the accumulating water to reduce the flow of air through the opposing third stage lower apertures 88, as shown in FIG. 13B. When the water level in the first chamber 120 exceeds the height 110 of the opposing third stage lower apertures 88, air flow through the opposing third stage lower apertures 88 occurs only through the opposing third stage upper apertures 92, which are well above the water level, as shown in FIG. 13C. This redirection of air flow through the opposing third stage upper apertures 92 prevents the ejection of water from the first chamber 120 to the interior environment 132. However, in the very early stages of water accumulation in the first chamber 120, some air moves through the opposing third stage lower apertures 88. The first baffle 24 and the second baffle 26 in the first chamber 120 prevent entrainment and ejection of water from the first chamber 120 to the interior environment 132.

When the water level in the first chamber 120 and the second chamber 122 is sufficiently high to obstruct air flow through the opposing third stage lower apertures 88, as shown in FIG. 13C, the effective sum of the cross sectional areas of the apertures of the third stage 16 is reduced to the sum of the cross sectional areas 118 of the opposing third stage upper apertures 92 to A3≈1.1 sq. inches. In this case, the predicted air pressures (gauge) in the fourth chamber 126, the third chamber 124, the second chamber 122, and first chamber 120, respectively, are as follows:

$P_E \approx 3.10$ psf≈0.595 inches WC $P_D \approx 0.04$ psf≈0.007 inches WC $PC \approx 0.03$ psf≈0.006 inches WC $P_B \approx 0.00$ psf≈0.000 inches WC This air pressure differential between the first chamber 120 and the second chamber 122 still allows water to flow with relative ease from the first chamber 120 to the second chamber 122. In addition, the low air pressure differential between the second chamber 122 and the third chamber 124 also allows water to flow with relative ease from the second chamber 122 to the third chamber 124. However, the high air pressure drop from the fourth chamber 126 to the third chamber 124 is $P_E - P_D \approx 3.06$ psf 0.59 inches WC, which does not allow water to flow from the third chamber 124 to the fourth chamber 126.

Figure 13D:
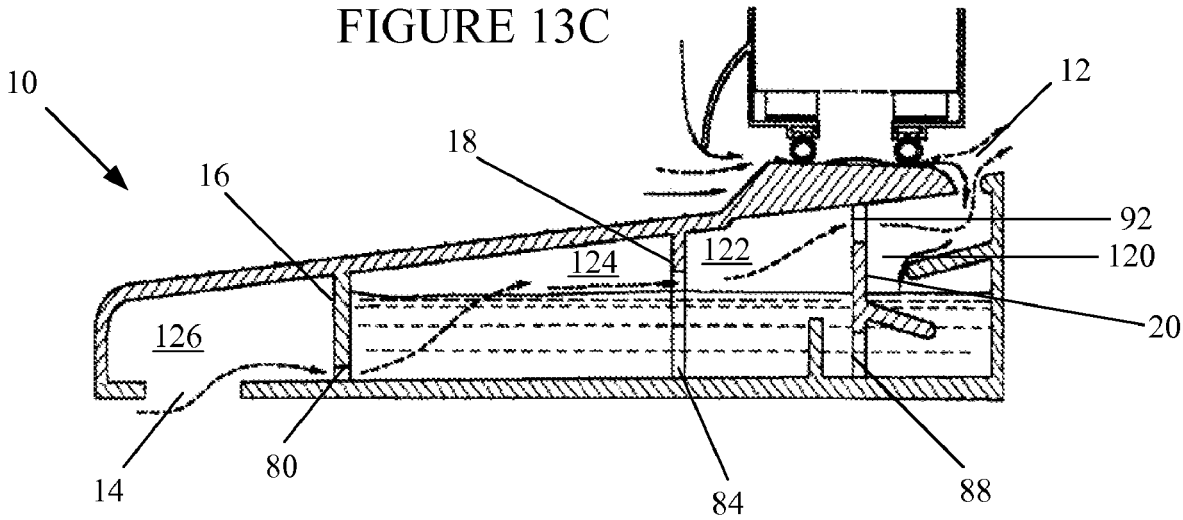
FIG. 13D shows a cross sectional view of the door threshold water return system of FIG. 1, during another step of the method shown in FIG. 12.

As water continues to accumulate in the first chamber 120, the second chamber 122, and the third chamber 124, respectively, the total effective cross sectional area of the opposing second stage lower apertures 84 is reduced, as shown in FIG. 13D. For example, when the water level in the first and second chambers 120 and 122, respectively, reaches approximately 7/16th inch, the effective cross sectional area of the opposing second stage lower apertures 84 is reduced to $A_2 \approx 0.25$ sq. inch. In this case, the predicted air pressures (gauge) in the fourth chamber 126, the third chamber 124, the second chamber 122, and first chamber 120, respectively, are as follows:

$P_E \approx 3.10$ psf≈0.595 inches WC $P_D \approx 0.52$ psf≈0.100 inches WC $P_C \approx 0.02$ psf≈0.005 inches WC $P_B \approx 0.00$ psf≈0.000 inches WC The air pressure differential between the first chamber 120 and the second chamber 122 still allows water to flow with relative ease from the first chamber 120 to the second chamber 122; however, the air pressure drop from the third chamber 124 to the second chamber 122 increases to $P_D - P_C \approx 0.50$ psf≈0.10 inch WC. Therefore, water can only flow from the second chamber 122 to the third chamber 124 when the water level in the second chamber 122 is at least 0.10 inches higher than the water level in the third chamber 124. The air pressure drop from the fourth chamber 126 to the third chamber 124 is reduced to $P_E - P_D \approx 2.58$ psf≈0.50 inch WC, which still does not allow water to flow from the third chamber 124 to the fourth chamber 126.

As the water level in the second chamber 122 approaches the height 104 of each of the opposing second stage lower apertures 84 (½ inch), the air flow and water flow become dynamic. The total head pressure at the interior 50 of the lower sill 30 of the third chamber 124 is still less than 0.60 inch WC, so that air continues to flow from the fourth chamber 126 to the third chamber 124 through the opposing first stage lower apertures 80. When air moves from the fourth chamber 126 to the third chamber 124 and when the opposing second stage lower apertures 84 are covered by water, the pressure in the third chamber 124 temporarily increases. This temporary increase in pressure causes an air bubble to move through upper portions 168 of the opposing second stage lower apertures 84 into the second chamber 122. (From the second chamber 122, the air continues through the opposing third stage upper apertures 92, above the water level in the first chamber 120 and outward to the water inlet 12 (which also serves as a low pressure side air outlet), out the water inlet 12, and into region 170 above and in the vicinity of the rear wall 34.) Loss of air from the third chamber 124 causes the pressure to temporarily decrease, which results in water flow from the second chamber 122 to the third chamber 124 and additional air flow from the fourth chamber 126 to the third chamber 124. This causes another temporary pressure increase in the third chamber 124, which repeats the air bubble movement from the third chamber 124 to the second chamber 122.

Figure 13E:
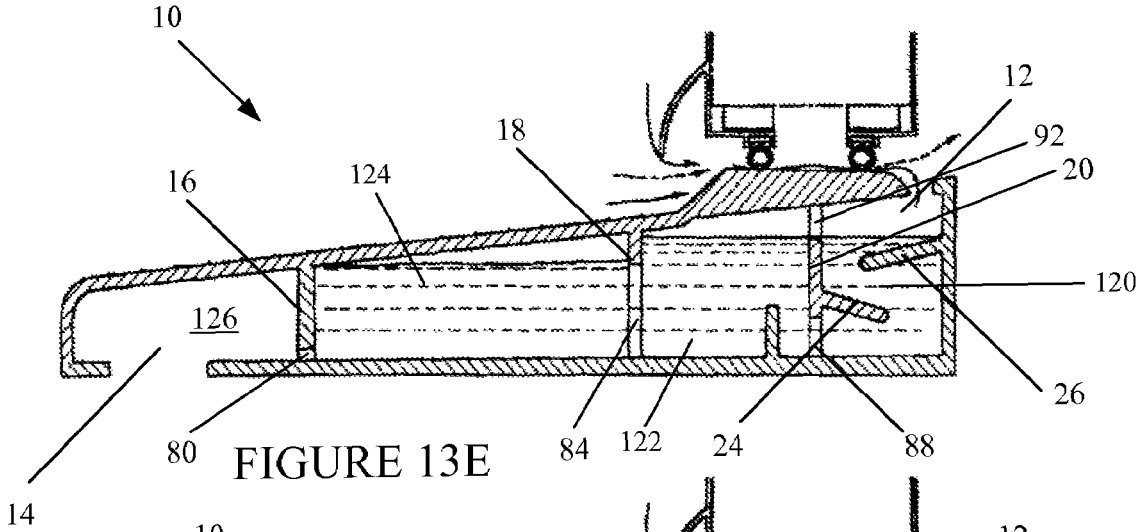
FIG. 13E shows a cross sectional view of the door threshold water return system of FIG. 1, during another step of the method shown in FIG. 12.

Air flow through the opposing second stage lower apertures 84 stops when the water level in the second chamber 122 is greater than 0.60 inch and the water level in the third chamber 124 is greater than 0.50 inch, as shown in FIG. 13E. This is because the opposing second stage lower apertures 84 are covered by water and the head of water column in the first and second chambers 120 and 124, respectively, (0.60 inch WC) is greater than the exterior side air pressure of 3.1 psf≈0.595 inches WC. For this condition, air (bubbles) cannot pass through the water.

Figure 13F:
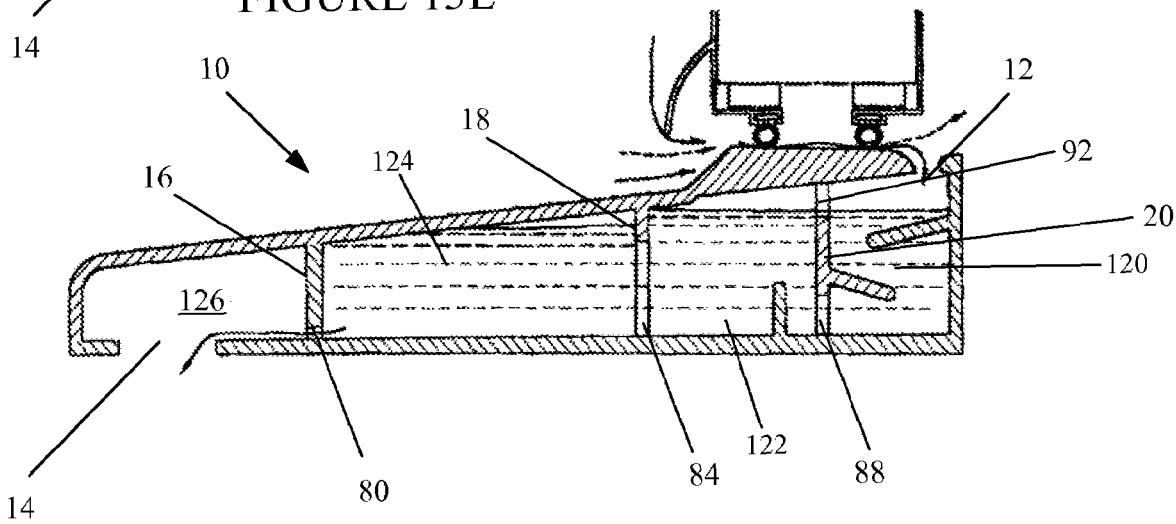
FIG. 13F shows a cross sectional view of the door threshold water return system of FIG. 1, during another step of the method shown in FIG. 12.

When air flow through the opposing second stage lower apertures 84 stops, air flow through the entire door threshold water return system 10 stops. Air pressure above the water in the first and second chambers 120 and 122, respectively, equalizes to zero gauge pressure, owing to the opposing third stage upper apertures 92. Air is trapped in upper portion 172 of the third chamber 124 and water flows from the second chamber 122 to the third chamber 124. This results in increasing total head pressure at the interior 50 of the lower sill 30 of the third chamber 124. When the total head pressure at the interior 50 of the lower sill 30 of the third chamber 124 exceeds 0.60 inch WC, water flows from the third chamber 124 to the fourth chamber 126, and exits the door threshold water return system 10 at the water outlet 14, as shown in FIG. 13F.

Figure 13G:
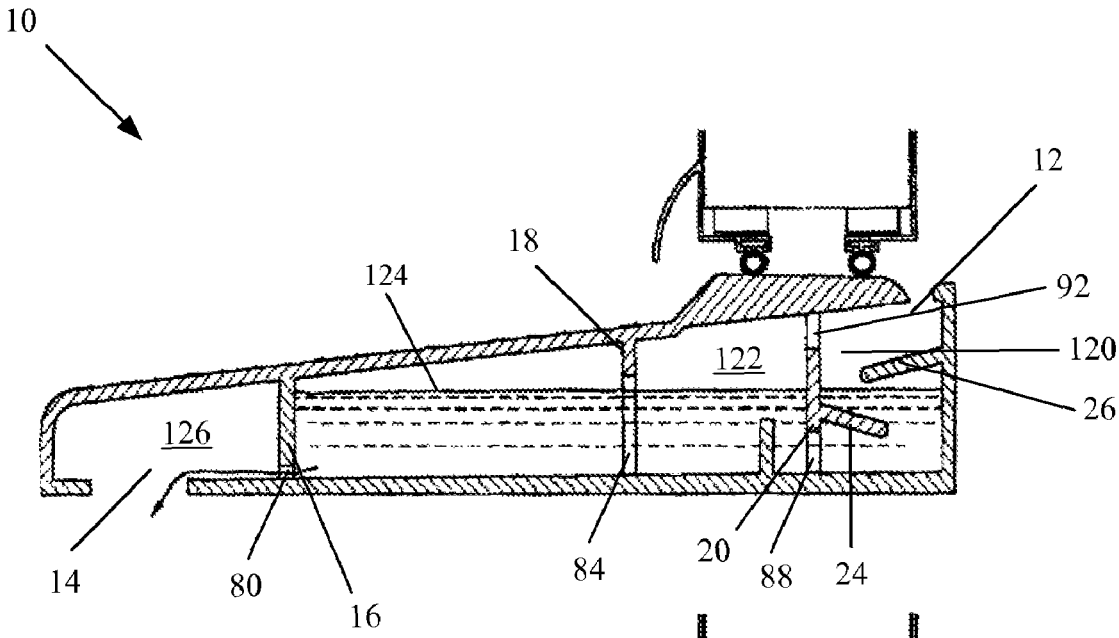
FIG. 13G shows a cross sectional view of the door threshold water return system of FIG. 1, during another step of the method shown in FIG. 12.
Figure 13H:
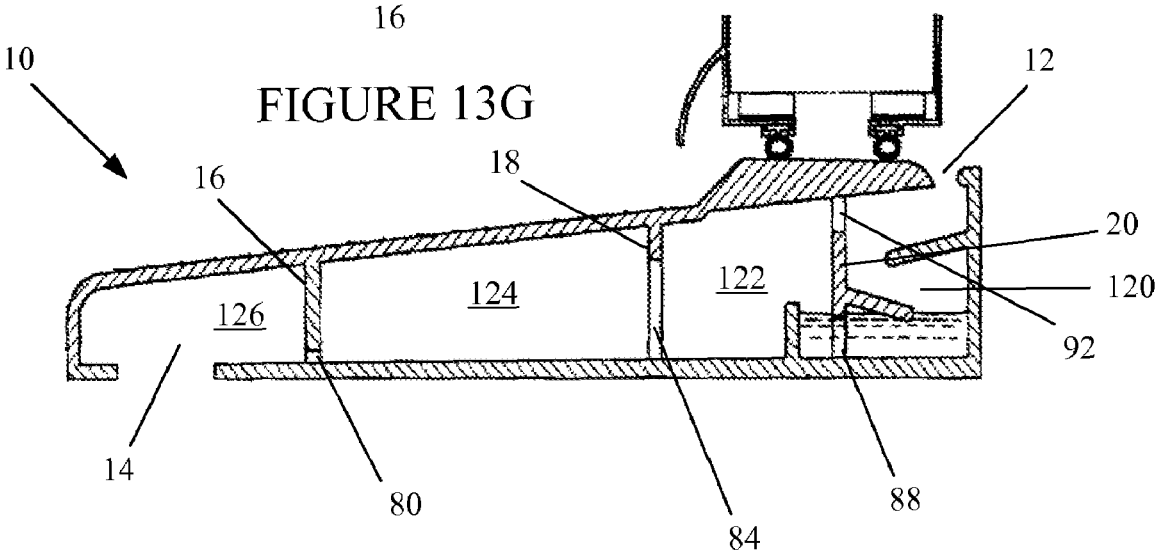
FIG. 13H shows a cross sectional view of the door threshold water return system of FIG. 1, during another step of the method shown in FIG. 12.
Figure 14:
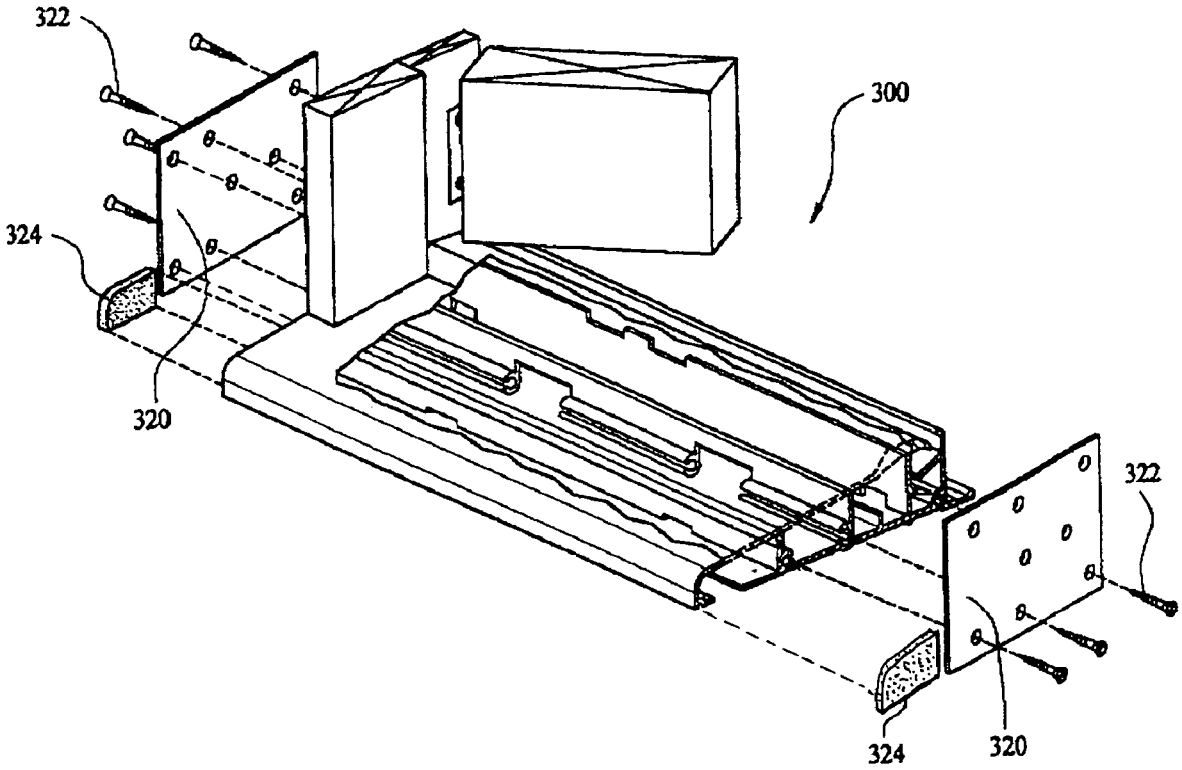
FIG. 14 is a cutaway perspective view of another embodiment of the door threshold water return system.
Figure 15:
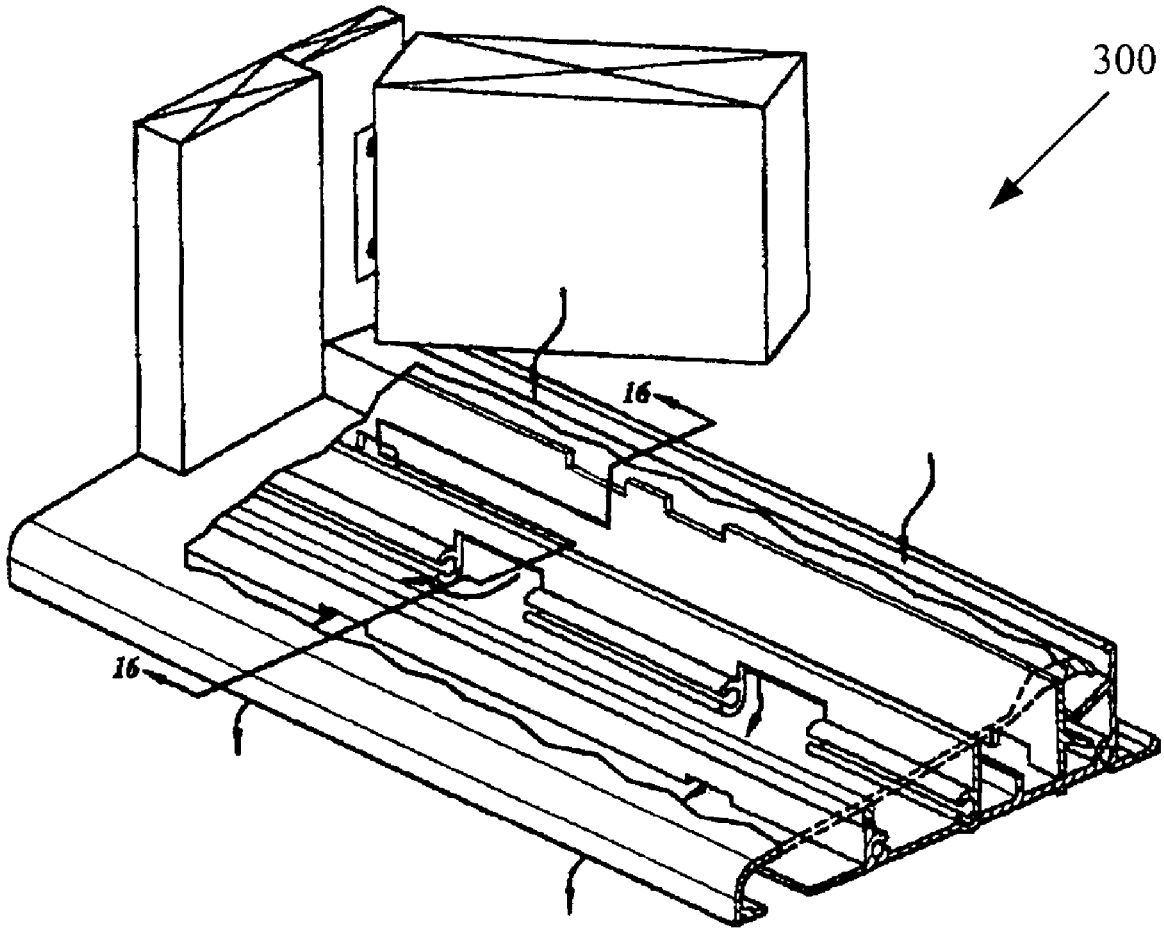
FIG. 15 is a cutaway perspective view of the door threshold water return system of FIG. 14, showing a water return path.
Figure 16:
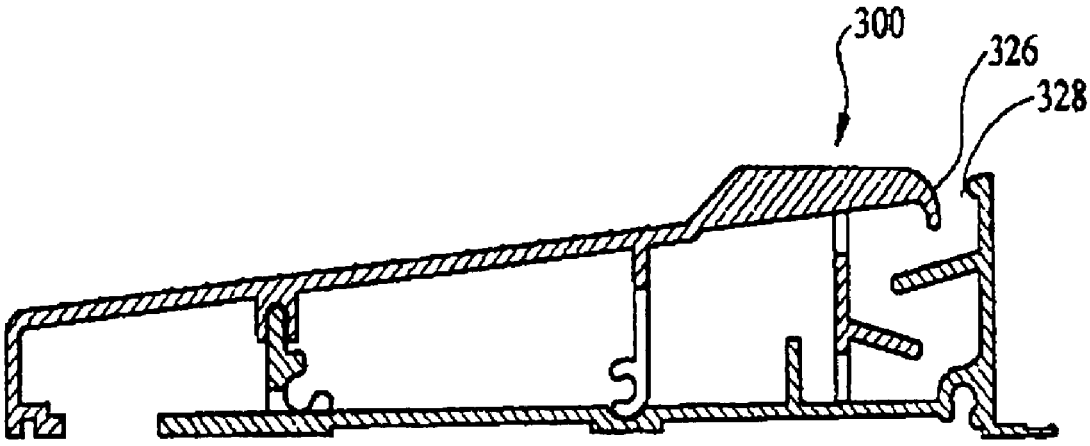
FIG. 16 is a cross sectional view of the door threshold water return system of FIG. 14.
Figure 17:
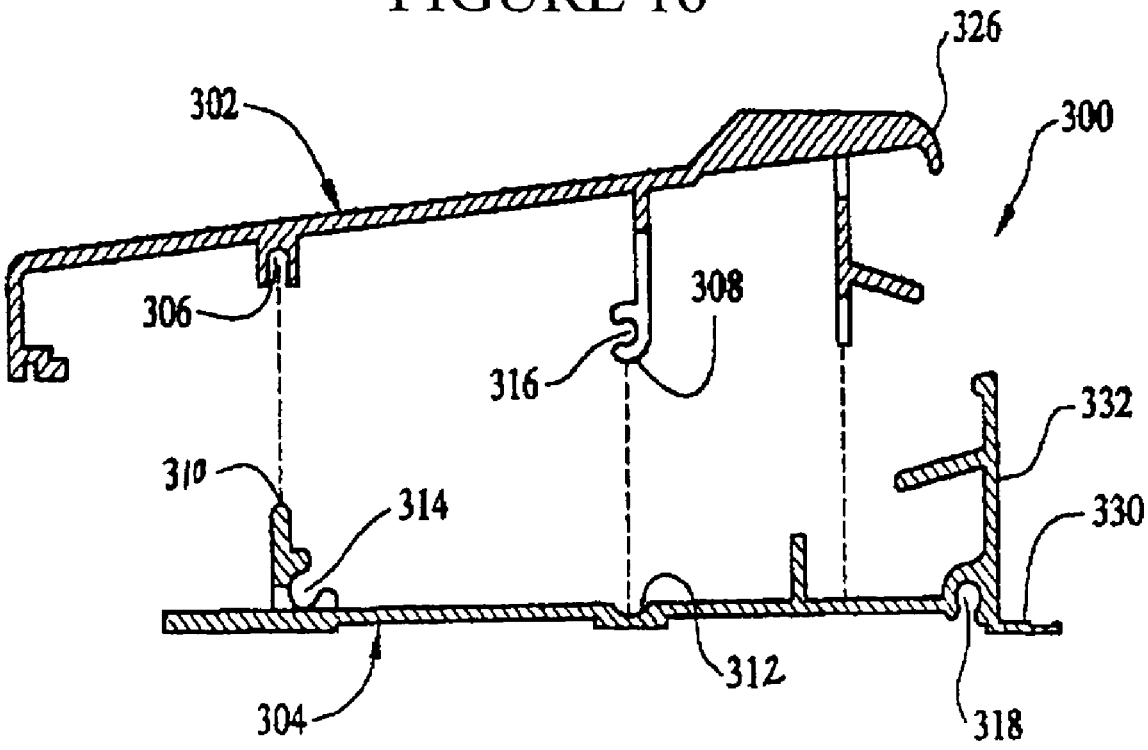
FIG. 17 is an exploded cross sectional view of the door threshold water return system of FIG. 14.
Figure 18:
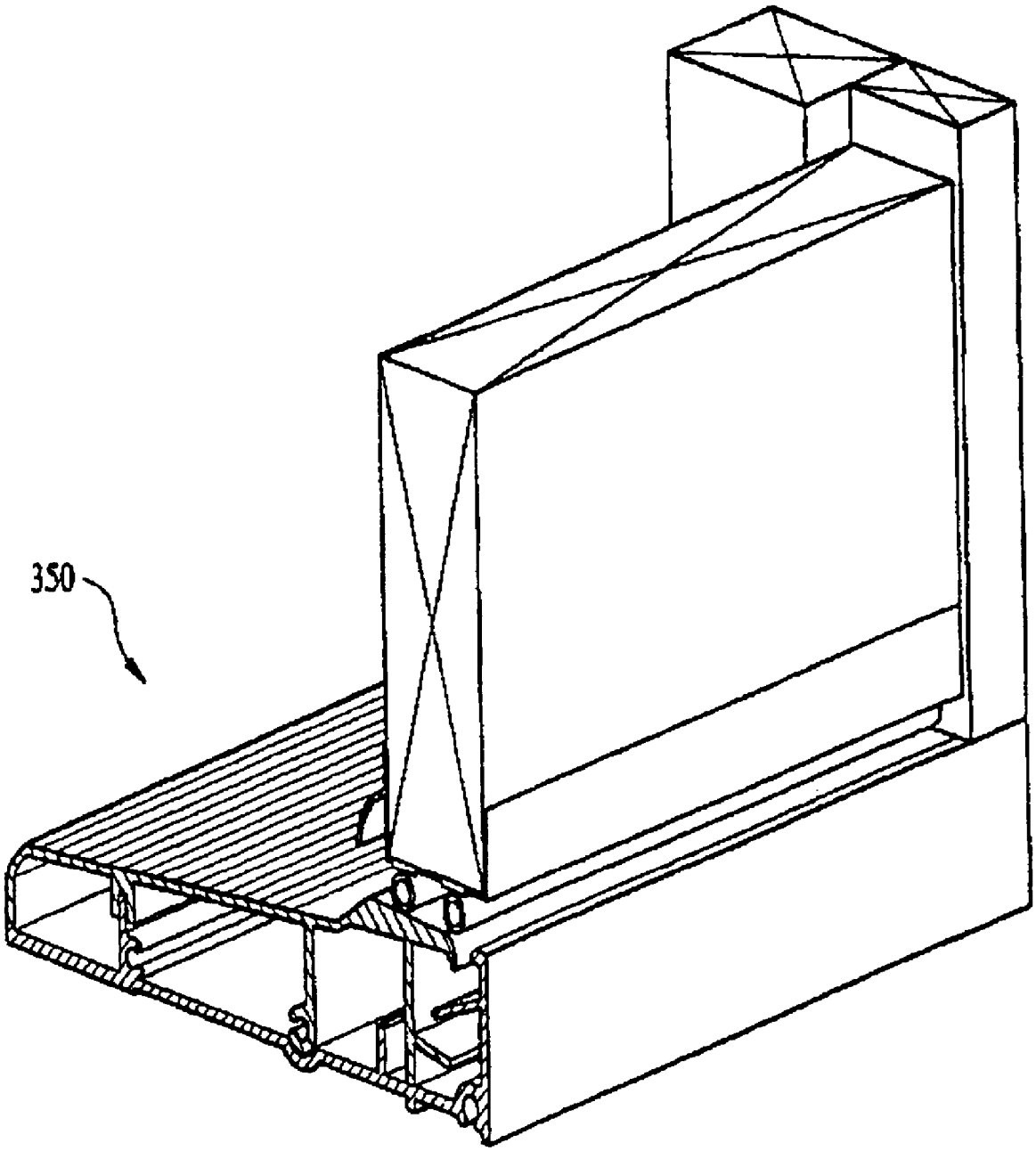
FIG. 18 is a cutaway perspective view of yet another embodiment of the door threshold water return system, installed beneath an exterior door and a jamb, showing the exterior door closed.
Figure 19:
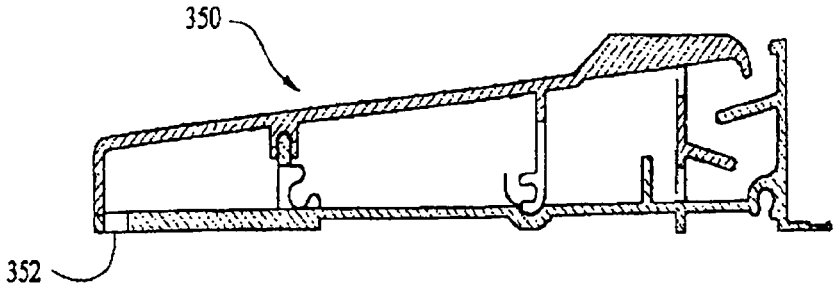
FIG. 19 is a cross sectional view of the door threshold water return system of FIG. 18.
Figure 20:
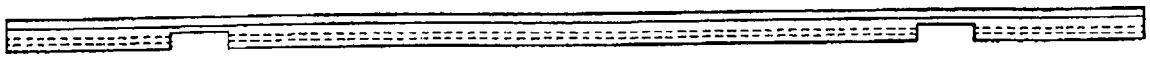
FIG. 20 is a front view of a first stage of the door threshold water return system of FIG. 18.
Figure 21:
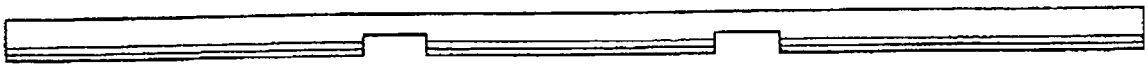
FIG. 21 is a front view of a second stage of the door threshold water return system of FIG. 18.
Figure 22:
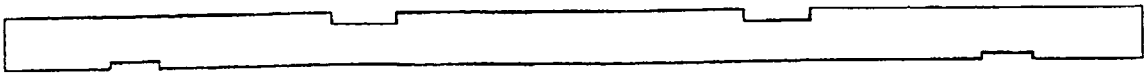
FIG. 22 is a front view of a third stage of the door threshold water return system of FIG. 18.
Figure 23:
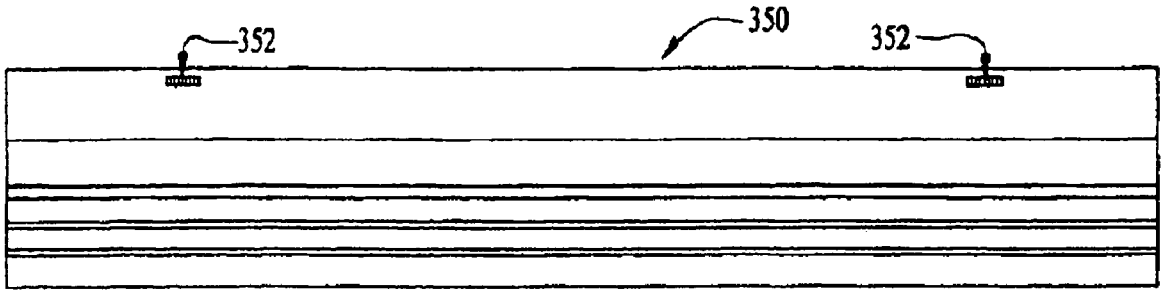
FIG. 23 is a bottom view of the door threshold water return system of FIG. 18.

When an air pressure difference is no longer exerted across the exterior door 136 and the door threshold water return system 10, water continues to drain from the door threshold water return system 10, as shown in FIG. 13G. A small amount of water remains in the first chamber 120 and the second chamber 122, as shown in FIG. 13H.

Typical performance and design values were discussed above for the door threshold water return system 10, although other suitable performance requirements and/or design values may be used.

The door threshold water return system 10 discussed above and presented here was designed to meet most existing fenestration certification programs, including the potential new harmonized 101.I.S2-A440 North American Fenestration Standard, which include requirements for air flow and water penetration resistance for any air pressure differential equal to or less than 3.1 psf. However, the door threshold water return system 10 may be configured to meet other suitable performance requirements.

Various tests performed on the door threshold water return system 10 include:

1) AAMA Closing Force.

2) ASTM E 283—Standard Test Method for Determining Rate of Air Leakage Through Exterior Windows, Curtain Walls, and Doors Under Specified Pressure Difference Across the Specimen.

3) ASTM E 547—Standard Test Method for Water Penetration of Exterior Windows, Skylights, Doors, and Curtain Walls by Cyclic Static Air Pressure Difference.

4) ASTM E 331—Standard Test Method for Water Penetration of Exterior Windows, Skylights, Doors, and Curtain Walls by Uniform Static Air Pressure Difference.

The following test results were achieved on the door threshold water return system 10, based upon the above testing standards:

1) PASS—Measured closing force of 9.76 foot lbs force to latch. Allowable=15.0 foot lbs force.

2) PASS—Total airflow across test area of 7.02 standard cubic feet per minute (scfm). Extraneous airflow of 3.31 scfm. Actual flow rate across specimen (7.02-3.31)=3.71 scfm. Total specimen airflow rate divided by total area of specimen (20 sq. ft)=0.19 scfm/ft$^2$. Allowable=0.30 scfm/ft$^2$.

3) PASS—Specimen subjected to eight (8) repetitive five (5) minute test cycles at 3.1 pounds per square foot (psf) =0.60" WC, with a sixty (60) second relaxation period between each test cycle. Exterior face of specimen exposed to continuous water impingement at a rate of 6 gph/ft$^2$. No water ingress.

4) PASS—Specimen subjected to one (1) continuous ninety (90) minute test cycle with no relaxation periods at 3.1 psf=0.60" WC. Exterior face of specimen exposed to continuous water impingement at a rate of 6 gph/ft$^2$. No water ingress.

Alternative embodiments of the door threshold water return system 10, utilizing the fluid mechanic principles described herein, may have a different number of stages, and, thus, a different number of chambers than the embodiments of the door threshold water return system 10 described herein, stages being defined as the vertical members that divide the door threshold water return system 10 into chambers, which may also be referred to as regions.

Alternative embodiments of the door threshold water return system 10 may have zero, one, two, three, or more stages, and, thus, one, two, three, four, or more chambers, respectively. The minimum number of stages required is zero. To achieve desired water return performance for various air pressure differentials, there are substantially two basic principles that may be used for design of alternative embodiments of the door threshold water return system 10:

1) Create a high air pressure difference near the front of the door threshold water return system and a low air pressure difference near the rear of the door threshold water return system (by the installation of small aperture(s) near the front of the door threshold water return system and large aperture (s) near the rear of the door threshold water return system).

2) Direct the flow of air above the water level near the rear of the door threshold water return system, such that air does not flow through the water near the rear of the door threshold water return system.

FIGS. 14-17 show an alternate embodiment of a door threshold water return system 300, which is substantially the same as the door threshold water return system 10, except that the door threshold water return system 300 has: mating upper sill 302 and mating lower sill 304, which mate one to the other; mating portions 306 and 308 of the upper sill 302, and mating portions 310 and 312 of the lower sill 304, which facilitate mating the upper sill 302 to the lower sill 304 one to the other, respectively; screw dogs 314, 316, and 318 for fastening end plates 320 to the upper sill 302 and the lower sill 304 thereto with fasteners 322; foam inserts 324 adjacent the end plates 320; arcuate upper shoulder 326 at water inlet 328; and the lower sill 304 having lip 330 extending beyond rear wall 332.

The upper sill 302 and the lower sill 304 are each generallu of extruded construction, and facilitate manufacture of the door threshold water return system 300, although other suitable construction may be used. The door threshold water return system 300 may be of metal, such as aluminum or steel, thermoplastics, thermosetting polymers, rubber, or other suitable material or combination thereof.

FIGS. 18-23 show another alternate embodiment of a door threshold water return system 350, which is substantially the same as the door threshold water return system 300, except that the door threshold water return system 350 has water outlets 352.

Figure 24:
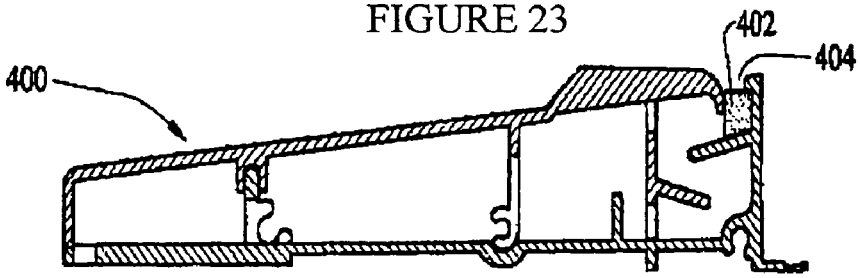
FIG. 24 is a cross sectional view of yet another embodiment of the door threshold water return system.

FIG. 24 shows another alternate embodiment of a door threshold water return system 400, which is substantially the same as the door threshold water return system 350, except that the door threshold water return system 400 has foam insert 402, which prevents detritus from entering the door threshold water return system 400 at water inlet 404 of the door threshold water return system 400, and which prevents insects from entering the interior of the residential building.

Figure 25:
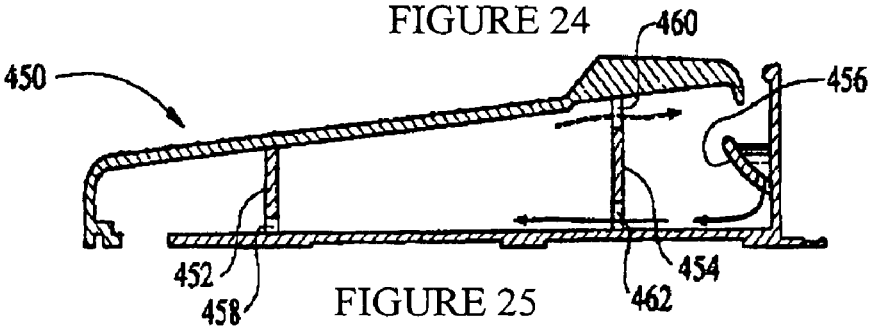
FIG. 25 is a cross sectional view of an alternate embodiment of the door threshold water return system.

FIG. 25 shows another alternate embodiment of a door threshold water return system 450, which is substantially the same as the door threshold water return system 10, except that the door threshold water return system 450 has two stages, i.e., first stage 452 and second stage 454, and one arcuate shaped baffle 456. The largest air pressure drop occurs across small first stage lower apertures 458 in the first stage 452. This ensures a negligible air pressure drop and very low air velocity through the second stage 454. Air is directed through second stage upper apertures 460 in the second stage 454, while water is directed in the opposite direction through second stage lower apertures 462 in the second stage 454. The arcuate shaped baffle 456 shields the water from shear forces exerted by the air, thus preventing entrainment and ejection of the water.

Figure 26:
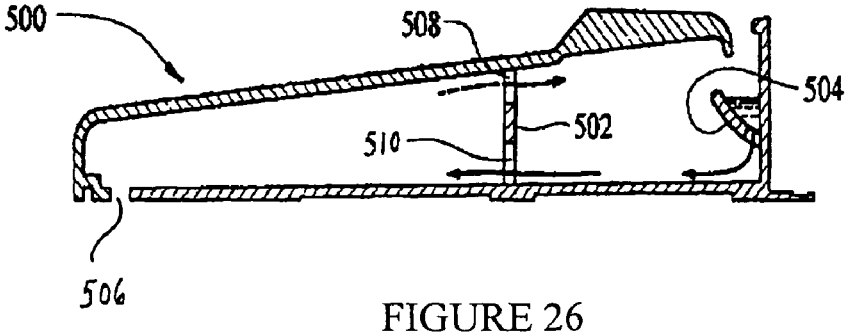
FIG. 26 is a cross sectional view of another alternate embodiment of the door threshold water return system.

FIG. 26 shows another alternate embodiment of a door threshold water return system 500, which is substantially the same as the door threshold water return system 10, except that the door threshold water return system 500 has one stage 502 and one arcuate shaped baffle 504. The largest air pressure drop occurs across water outlet 506, which ensures a negligible air pressure drop and very low air velocity through the stage 502. Air is directed through stage upper apertures 508 in the stage 502, while water is directed in the opposite direction through stage lower apertures 510 in the stage 502.

Figure 27:
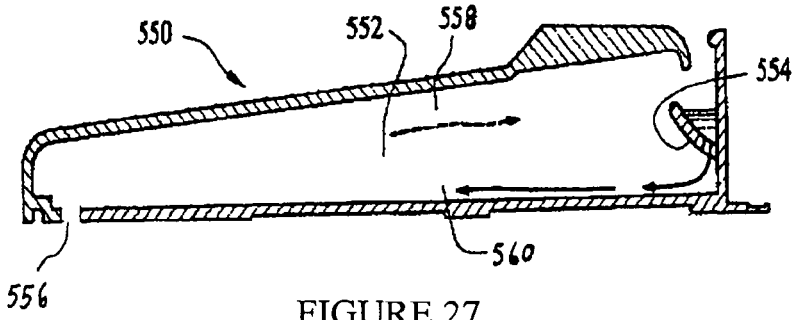
FIG. 27 is a cross section view of yet another alternate embodiment of the door threshold water return system.

FIG. 27 shows another alternate embodiment of a door threshold water return system 550, which is substantially the same as the door threshold water return system 10, except that the door threshold water return system 550 has one chamber 552, zero stages, and one arcuate shaped baffle 554. The largest air pressure drop occurs across water outlet 556. Air flow is directed through upper region 558 of the chamber 552, while water is directed in the opposite direction through lower region 560 of the door threshold water return system 550.

Figure 28:
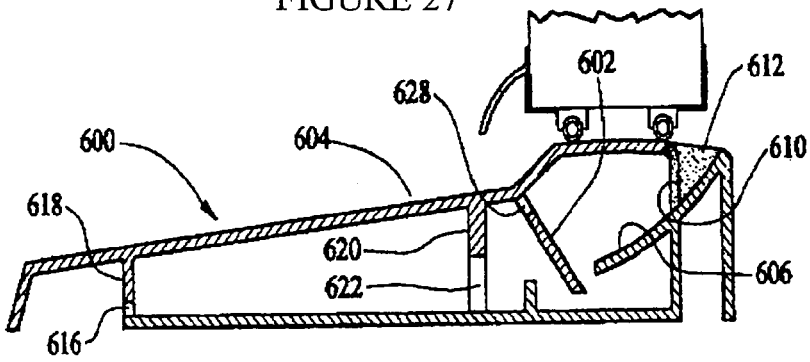
FIG. 28 is a cross section view of still another alternate embodiment of the door threshold water return system.
Figure 29:
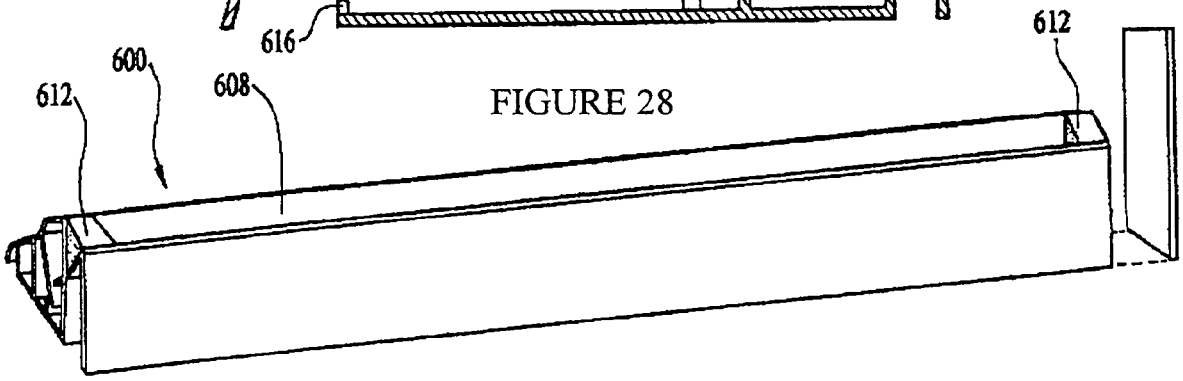
FIG. 29 is a rear perspective view of the door threshold water return system of FIG. 28.
Figure 30:
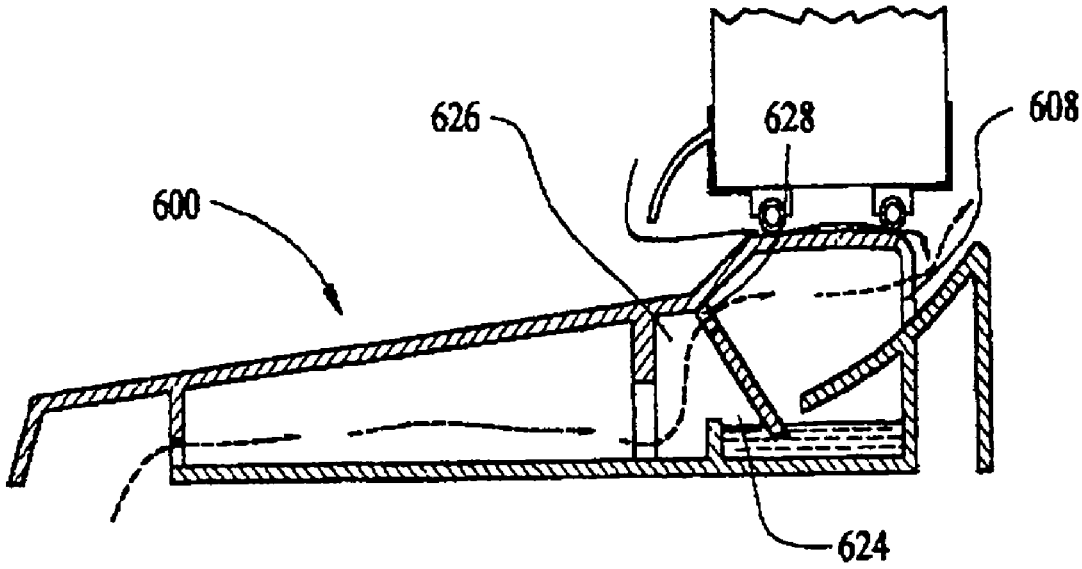
FIG. 30 is a cross sectional view of the door threshold water return system of FIG. 28, showing the system partially filled with water, and showing air flow and water flow.

FIGS. 28-30 show another alternate embodiment of a door threshold water return system 600, which is substantially the same as the door threshold water return system 10, except that the door threshold water return system 600 has a third stage 602 upwardly inclined toward inclined sill portion 604, arcuate shaped baffle 606, water receiving trough 608, substantially vertically disposed opposing water inlets 610, and opposing foam inserts 612 adjacent the opposing water inlets 610, which prevent detritus from entering the door threshold water return system 600 through the opposing water inlets 610 of the door threshold water return system 600, and which prevent insects from entering the interior of the residential building. The largest air pressure drop occurs across small first stage lower apertures 616. This ensures a negligible air pressure drop and very low air velocity through the door threshold water return system 600 and through second stage 620, which has a second stage lower aperture 622, which has a substantially larger cross sectional area than the sum of the cross sectional areas of the small first stage lower apertures 616. When there is no water in the door threshold water return system, as shown in FIG. 28, air flows through all apertures and chambers. The inclined third stage 602 and the arcuate shaped baffle 606 prevent water entrainment and ejection, when there is a very small amount of water in the door threshold system 600. As shown in FIG. 30, air is prevented from flowing through lower portion 624 of second chamber 626, thereby directing air flow well above the water level, through third stage upper aperture 628 of the inclined third stage 602.

Figure 31:
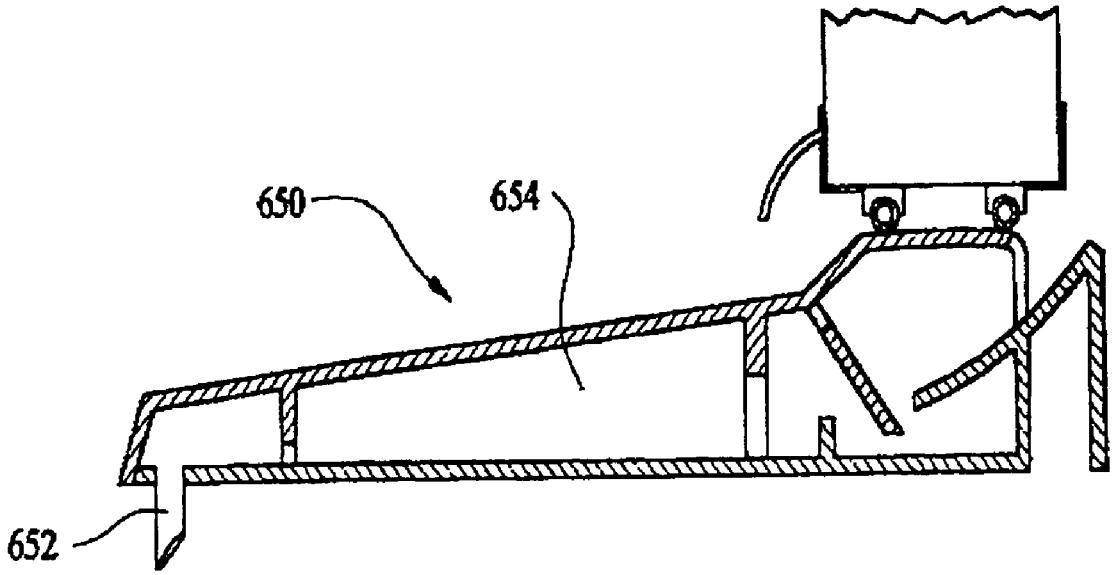
FIG. 31 is a cross sectional view of another alternate embodiment of a door threshold water return system.

FIG. 31 shows another alternate embodiment of a door threshold water return system 650, which is substantially the same as the door threshold water return system 600, except that the door threshold water return system 650 has a tubular water outlets 652. The largest pressure drop occurs through the tubular water outlets 652, which ensures a negligible air pressure drop and very low air velocity through the interior 654 of the door threshold water return system 650. Owing to the additional vertical height of water column that can be accumulated in the door threshold water return system 650, the door threshold water return system 650 can prevent water ingress for much higher air pressure differentials than 3.1 psf.

Figure 32:
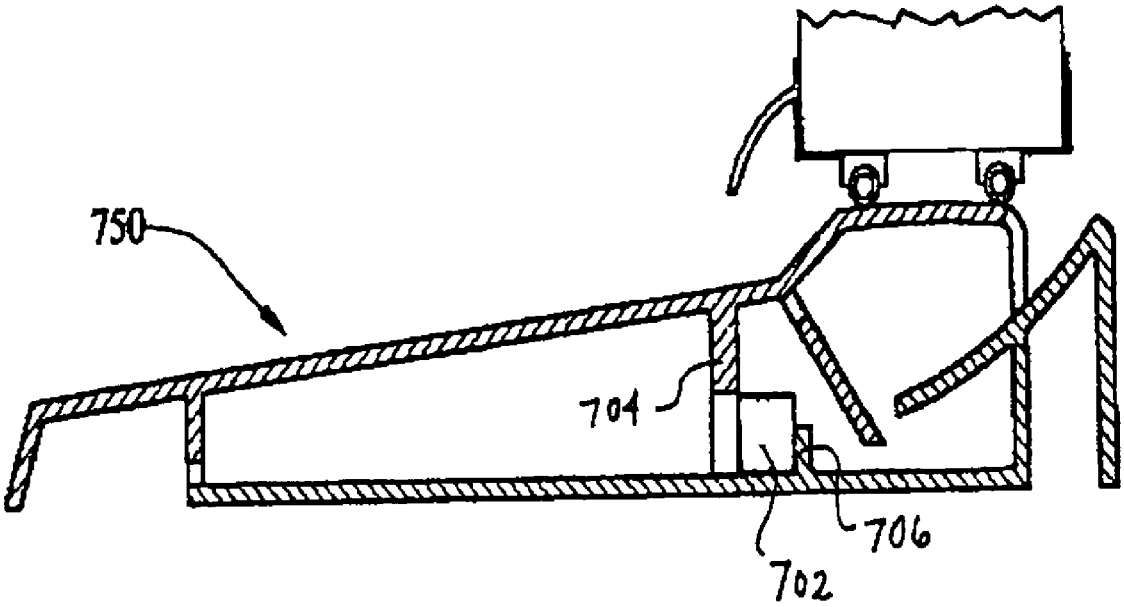
FIG. 32 is a cross sectional view of another alternate embodiment of a door threshold water return system.

FIG. 32 shows another alternate embodiment of a door threshold water return system 700, which is substantially the same as the door threshold water return system 600, except that the door threshold water return system 700 has opposing foam inserts 702 adjacent second stage 704 and water dam 706, which serve as an air baffle and also prevents insects from entering the interior of the residential building.

Figure 33:
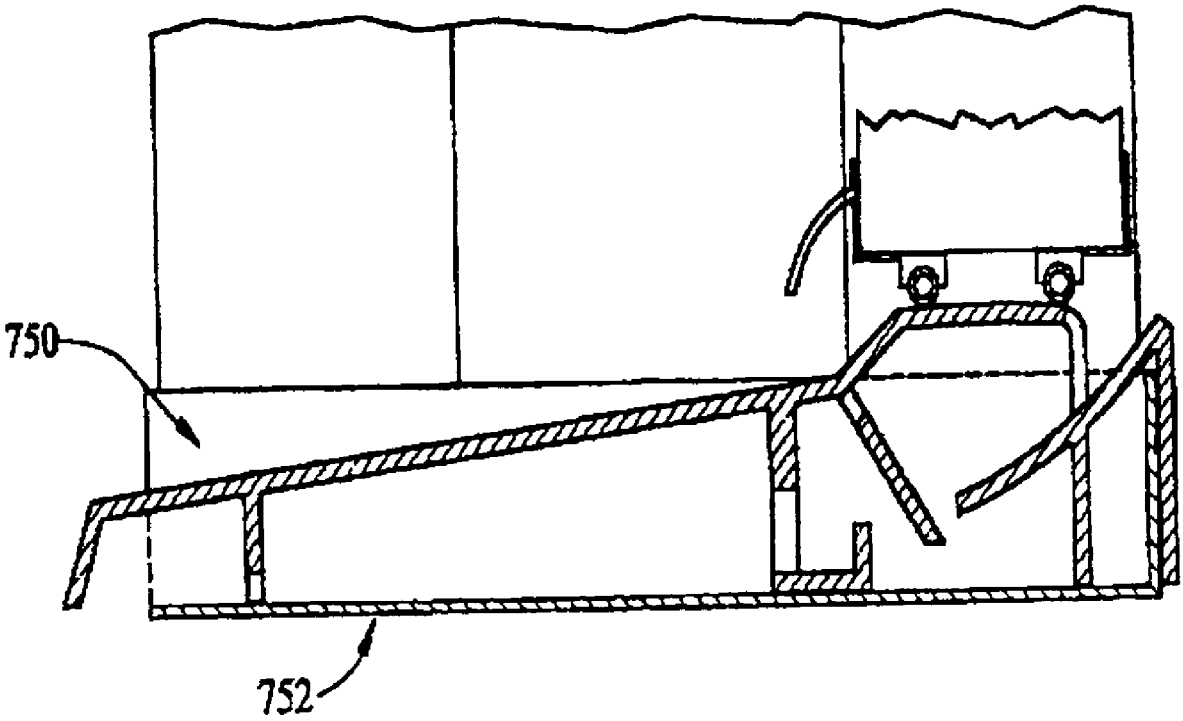
FIG. 33 is a cross sectional view of another alternate embodiment of a door threshold water return system.
Figure 34:
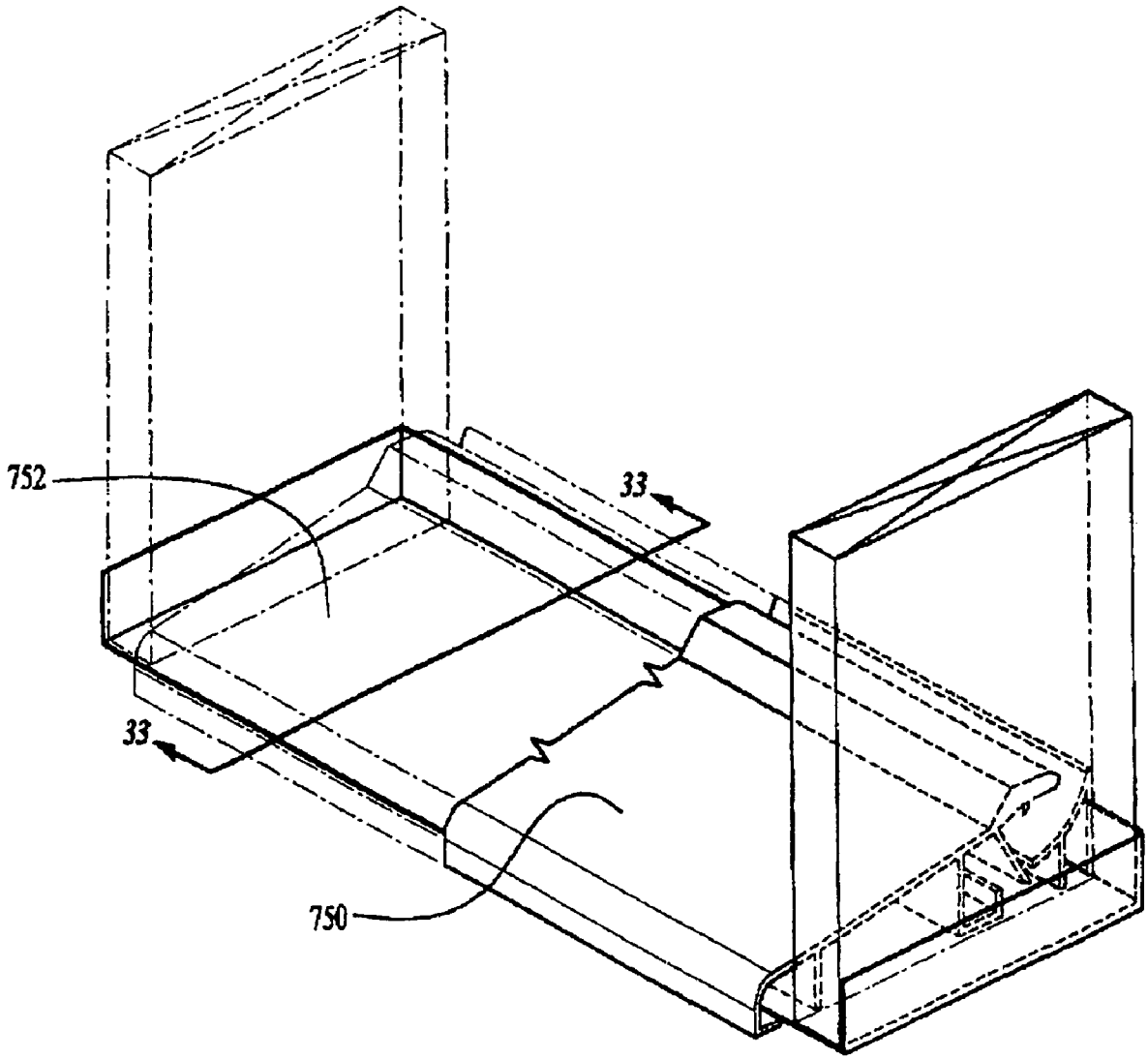
FIG. 34 is a perspective view of the door threshold water return system of FIG. 33, installed with adjacent door jambs.

FIGS. 33 and 34 show another alternate embodiment of a door threshold water return system 750, which is substantially the same as the door threshold water return system 600, except that the door threshold water return system 750 has a lower sill pan 752 for less expensive construction.

While certain embodiments of the present invention have been described, it will be understood that various changes may be made in the above inventions without departing from the scope of the invention. It is intended that all matter contained in the above description or shown in the accompanying drawings shall be interpreted as illustrative and not in a limiting sense.

We claim:

1. A door threshold water return system, comprising: a lower sill; an upper sill; a rear wall; a front wall forming a chamber; and at least one stage having a substantially planar structure dividing the chamber into at least a first chamber and a second chamber, wherein the at least one stage contacts the upper and lower sill, is substantially perpendicularly connected to the lower sill, and comprises at least one lower aperture at the bottom of the at least one stage and at least one upper aperture at the top of the at least one stage, wherein at least one baffle is provided projecting from the rear wall, a first gap is provided in the first chamber in proximity to the rear wall and between the upper sill and the rear wall, and a second gap is provided in the second chamber in proximity to the lower sill and between the lower sill and the front wall, whereby water introduced into the system through the first gap flows through the first chamber, the at least one lower aperture in the at least one stage, the second chamber, and exits the system though the second gap, and air introduced into the system through the second gap flows through the second chamber, the at least one lower aperture in the at least one stage, the first chamber, and exits the system through the first gap until the water level exceeds a height of the at least one lower aperture, when air introduced into the system through the first gap passes through the at least one upper aperture in the at least one stage and accumulates in upper regions of the first and second chambers.

2. The door threshold water return system of claim 1, wherein the upper sill is inclined relative to the lower sill.

3. The door threshold water return system of claim 1, wherein the upper sill and the front wall are integral and form an arcuate corner.

4. The door threshold water return system of claim 1, wherein the baffle is generally arcuately shaped.

5. The door threshold water return system of claim 1, wherein the system is constructed of materials selected from the group consisting of: metal, aluminum, steel, thermoplastics, thermosetting polymers, rubber, and combinations thereof.

6. A door threshold water return system, comprising: a lower sill; an upper sill; a rear wall; a front wall; a first stage, a second stage, and a third stage forming at least four internal chambers arranged in a side-by-side configuration, wherein the first, second, and third stages have substantially planar structures, wherein the first stage comprises at least one lower aperture, wherein the second stage comprises at least one lower aperture, wherein the third stage comprises at least one lower aperture and at least one upper aperture, wherein at least one baffle is provided projecting from the rear wall, a first gap is provided in proximity to the rear wall and between the upper sill and the rear wall, a second gap is provided in proximity to the lower sill and between the lower sill and the front wall, and the at least four internal chambers are in fluid communication with each other through the lower apertures and with the first and second gaps; whereby water introduced to the system though the first gap passes through the chambers and lower apertures and exits the second gap and air introduced to the system through the second gap passes through the chambers and lower apertures and exits the first gap until the water level in the chambers exceeds the height of the lower apertures, preventing air flow through the lower apertures.

7. The door threshold water return system of claim 6, wherein the first, second, and third stages are generally perpendicular to the lower sill.

8. The door threshold water return system of claim 6, wherein the at least one baffle inclines toward the third stage.

9. The door threshold water return system of claim 6, wherein the third stage additionally has a baffle inclined toward the rear wall.

10. The door threshold water return system of claim 6, wherein The system additionally has a protrusion connected to the lower sill and is in proximity to the third stage.

11. The door threshold water return system of claim 6, wherein a cross sectional area of the at least one lower aperture of the first stage is smaller than a cross sectional area of the at least one lower aperture of the second stage, and wherein a sum of cross sectional areas of the at least one lower aperture and the at least one upper aperture of the third stage is larger than the cross sectional area of the at least one lower aperture of the first stage.

12. The door threshold water return system of claim 6, wherein a cross sectional area of the at least one lower aperture of The first stage is about 0.11 square inch, wherein a cross sectional area of the at least one lower aperture of the second stage is about 2.0 square inches, and wherein a sum of cross sectional areas of the at least one lower aperture and the at least one upper aperture of the third stage is about 1.8 square inches.

* * * * *